US006776414B1

(12) United States Patent
Messac

(10) Patent No.: US 6,776,414 B1
(45) Date of Patent: Aug. 17, 2004

(54) ORIGINAL UNIVERSAL BOARD

(76) Inventor: Paule Messac, R.R. 1, Box 1240, Canton, ME (US) 04221

( * ) Notice: Subject to any disclaimer, the term of this patent is extended or adjusted under 35 U.S.C. 154(b) by 0 days.

(21) Appl. No.: 10/213,420

(22) Filed: Aug. 5, 2002

(51) Int. Cl.[7] ..... A63F 3/00
(52) U.S. Cl. ..... 273/284
(58) Field of Search ..... 273/284, 287, 273/283, 309, 236, 241, 275, 276, 282.1, 155, 156; D21/334, 336; 434/128, 129

(56) References Cited

U.S. PATENT DOCUMENTS

| | | | | |
|---|---|---|---|---|
| 463,654 | A | * 11/1891 | Vornbrock | 312/280 |
| 848,042 | A | * 3/1907 | Musgrave | 273/309 |
| 1,535,484 | A | * 4/1925 | Kohl | 273/309 |
| 1,754,130 | A | * 4/1930 | Uchiyama | 273/285 |
| 1,803,804 | A | * 5/1931 | Kolodny | 108/26 |
| 1,900,513 | A | * 3/1933 | Marsh | 273/309 |
| 2,008,078 | A | * 7/1935 | Martin | 108/26 |
| 2,174,613 | A | * 10/1939 | Blaschke | 221/199 |
| 4,065,125 | A | * 12/1977 | Chan | 473/14 |
| 4,630,831 | A | 12/1986 | Stadden | |
| 4,673,185 | A | 6/1987 | Morley, Jr. | |
| 4,783,081 | A | 11/1988 | Eckhardt | |
| 4,813,679 | A | 3/1989 | Hoffman | |
| 4,946,170 | A | 8/1990 | Mastro | |
| 5,087,052 | A | 2/1992 | Simon | |
| 5,108,109 | A | 4/1992 | Leban | |
| 5,405,147 | A | 4/1995 | Garcia | |
| 5,727,787 | A | 3/1998 | Salley | |
| 6,120,030 | A | 9/2000 | Chou | |

FOREIGN PATENT DOCUMENTS

| | | |
|---|---|---|
| DE | 19648004 | 5/1998 |
| EP | 0945155 | 9/1999 |

* cited by examiner

*Primary Examiner*—Vishu K Mendiratta
(74) *Attorney, Agent, or Firm*—Michael I. Kroll

(57) ABSTRACT

A universal game board having a plurality of pieces to configure various game boards accordingly for the game to be played. Stacked plates are used to vary the elevation of the playing surface as needed. Board bases are maintained by table frame assemblies and are configured to allow board bases to be secured adjacently for doubling, tripling or quadrupling the area of the playing surface.

10 Claims, 29 Drawing Sheets

ORIGINAL UNIVERSAL BOARD

BACKGROUND OF THE INVENTION

1. Field of the Invention

The present invention relates generally to board games and, more specifically, to a planar playing surface having a support structure and plurality playing pieces that can be used to create assorted game boards or games. The planar playing surface is of a square or rectangular shape that has a plurality of perpendicularly intersecting markings forming a grid that extends to the peripheral sides. Extending vertically downward are walls that are integral to the playing surface forming a board base in its entirety. Recesses are provided on each side of the board base so drawers having recessed handles and molded inserts may be placed therein to provide an area ideal for game piece storage. Storage may also be provided underneath the table base by means of recesses, drawers, bracket members or any other suitable unobtrusive method thereof.

Removably secured to the upper side portions of the board base, are members having typically an L-shape with markings that correspond to the grid embossed on the playing surface to create definable coordinates, this structure will hereinafter be referred to as board bounds, the board bounds extend horizontally and vertically on the playing surface and walls of the board base to provide a boundary around the playing surface and an attachable flange that extends from the walls.

Additionally pocketed board bounds are provided with a similar construction with the exception of recesses for pieces to pass through being provided on the interior surface for the placement of game pieces therein that may be used for, or in conjunction with, board bounds for game pieces to fall into.

Furthermore filler separators are provided that are very long pittances that have an extending planar construction that allows itself to be abutted to existing board bounds thus limiting the effective area of the playing surface.

To effectively support and elevate the playing surface, a support structure is provided having double legs and a frame. The double legs vertically extend upwardly at differentiating lengths to support a full frame. The full frame is of a shape mimicking the board base with a slightly larger surrounding area so that the board base may be placed inside the frame and suspended therefrom by means of board bounds that are removably attached to the upper outer perimeter of the board base. Any appropriate table frame configuration that allows for a plurality of board bases and support structures to be abutted next to one another and fixedly attached via a brace may be also be used.

Once the board has been assembled and the optional support structure has been attached, there are a plurality of pieces that can be used to create a game board where games can be played thereon or a plurality of game boards and games can be designed using the plurality of game pieces.

One such piece having typically a square shape and varying color, size, shapes and markings used to create a game board on the playing surface or as a marker is referred to as a pittance. Another piece having form and attributes similar to a pittance but of typically smaller size is called a pit, a pit is used as a marker on the playing surface or on pittances. Yet another piece is a single hole pittance having a single aperture or throughbore to allow pegs, nuts or bolts to pass through. Still yet another piece of the present invention is a peg like member, referred to as a baguette or pit pole having differentiating markings and a structure that allows for it's insertion into a pit. Another game piece used with a baguette having a form typically of a pittance with a plurality of apertures or holes is called a pit-hole. Yet another piece used in game play having an S-like shape, referred to as a lift piece, is used for lifting cornered pieces (game components) such as pits or pittances. Still yet another structure used in game play having a box like assembly wherein unused or discarded game pieces are placed is referred to as a freezer. A gaming piece used to either cover the entire board to provide a surface that can be used for other purposes than game play or to elevate portions of the board for game play having a flat thin planer construction of varying sizes is referred to as a plate. Many thin plates make a full plate (sectioned or otherwise) and provide readily available playing surfaces (combinations of thin plates). The plates interlock vertically or horizontally to extend the playing surface or pattern or stacked for a thicker full plate.

Additionally all prior mentioned components excluding the support structure may be contained within a carrying wrap for purposes relating to the easier transportation of the present invention to different locations. The carrying wrap having a handle, is comprised of a plurality of members. The members are assembles around the walls of the board base to enclose the board base in a manner that keeps the board base's drawers sealed closed so that game pieces are contained.

2. Description of the Prior Art

There are other board games designed for game play but while these board games may be suitable for the purposes for which they were designed, they would not be as suitable for the purposes of the present invention, as hereinafter described.

SUMMARY OF THE PRESENT INVENTION

A primary object of the present invention is to provide a game playing surface wherein a plurality of different games may be played using a plurality of game pieces.

Another object of the present invention is to provide a game-playing surface having an adjustable and changeable game playing surface area using board bounds.

Yet another object of the present invention is to provide a game playing surface having a changeable board layout using pittances.

Still yet another object of the present invention is to provide a game-playing surface having a board base suspended by a flange connected on a support structure's frame.

Yet another object of the present invention is to provide a support structure having double legs and a frame to support a board base having a plurality of drawers for storage.

Still yet another object of the present invention is to provide a support structure that has a suitable configuration for supporting more than one board base to allow for a plurality thereof to be joined together into a larger playing area or table surface.

Yet another object of the present invention is to provide a game-playing surface that may be converted into a flat surface using thin plates to create full instant playing surfaces that may be used for other purposes.

Still yet another object of the present invention is to provide a game-playing surface that can have elevated portions using a plate.

Yet another object of the present invention is to provide a game playing surface having markings on it's board bounds and playing surface so that coordinates may be established.

Still yet another object of the present invention is to provide a game utilizing differentiating markers such as pittances, pits, baguettes and pit-poles.

Yet another object of the present invention is to provide a carrying wrap for easier transportation of the present invention.

Still yet another object of the present invention is to provide a freezer for the storage and placement of unused or out of play game pieces.

Yet another object of the present invention is to provide a playing surface having board bounds that have apertures or pockets where game pieces can be dropped-in, fall-in or pass through.

Additional objects of the present invention will appear as the description proceeds.

The present invention overcomes the shortcomings of the prior art by providing a universal game board having a board base with drawers for game piece storage and a planer playing surface embossed with a grid and board bounds that create boundaries to the playing surface, a flange for attachment to a support structures frame and to present markings thereupon its top surface so that defined coordinates can be established.

Also, providing a support structure having double legs to elevate and support a frame used to suspend a board base or a means for joining together more than one table base such as a dual frame having frame members that hold two board bases that may joined together when three or four board bases are needed or a brace may be used to join two or more boards to create a larger playing surface.

Furthermore, thin plates may be placed over the playing surface supported by board bounds or game pieces to elevate selective portions of the playing surface or to cover the playing surface entirely to create a planer surface that may be used as a table for other purposes than game play.

Additionally, there are a variety of game pieces that allow for the game player to create assorted board designs and games using, pittances to design a board or mark it, pits to mark the board, baguettes to be inserted into pit-holes, pit holes to receive baguettes or pit-poles and mark the board, and a freezer for the storage of unused or discarded pieces with all said components varying in color, shape and size presenting bountiful gaming options.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DETAILED DESCRIPTION OF THE PREFERRED EMBODIMENTS

The following discussion describes in detail one embodiment of the invention and several variations of that embodiment. This discussion should not be construed, however, as limiting the invention to those particular embodiments. Practitioners skilled in the art will recognize numerous other embodiments as well. For a definition of the complete scope of the invention, the reader is directed to the appended claims.

Figure 1:
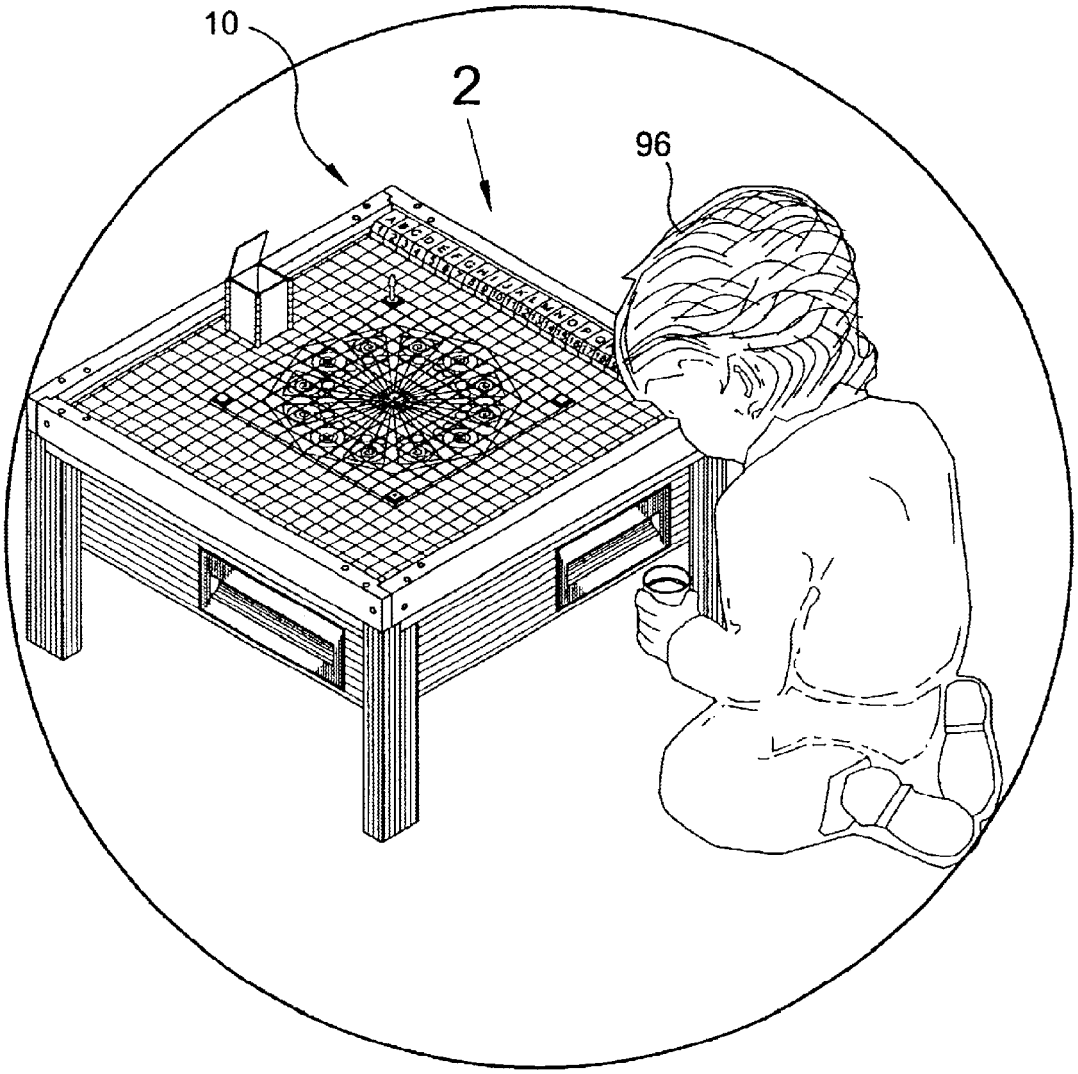
FIG. 1 is an illustrative view of the present invention in use.

FIG. 1 is an illustrative view of the present invention in use. FIG. 1 illustrates the present invention 10 with a user 96 preparing to play one of a plurality of possible games that may be played with the present invention due to its diverse quantity of changeable attributes in the respect of structure, size, indicia and color of the board base's playing surface.

Figure 2:
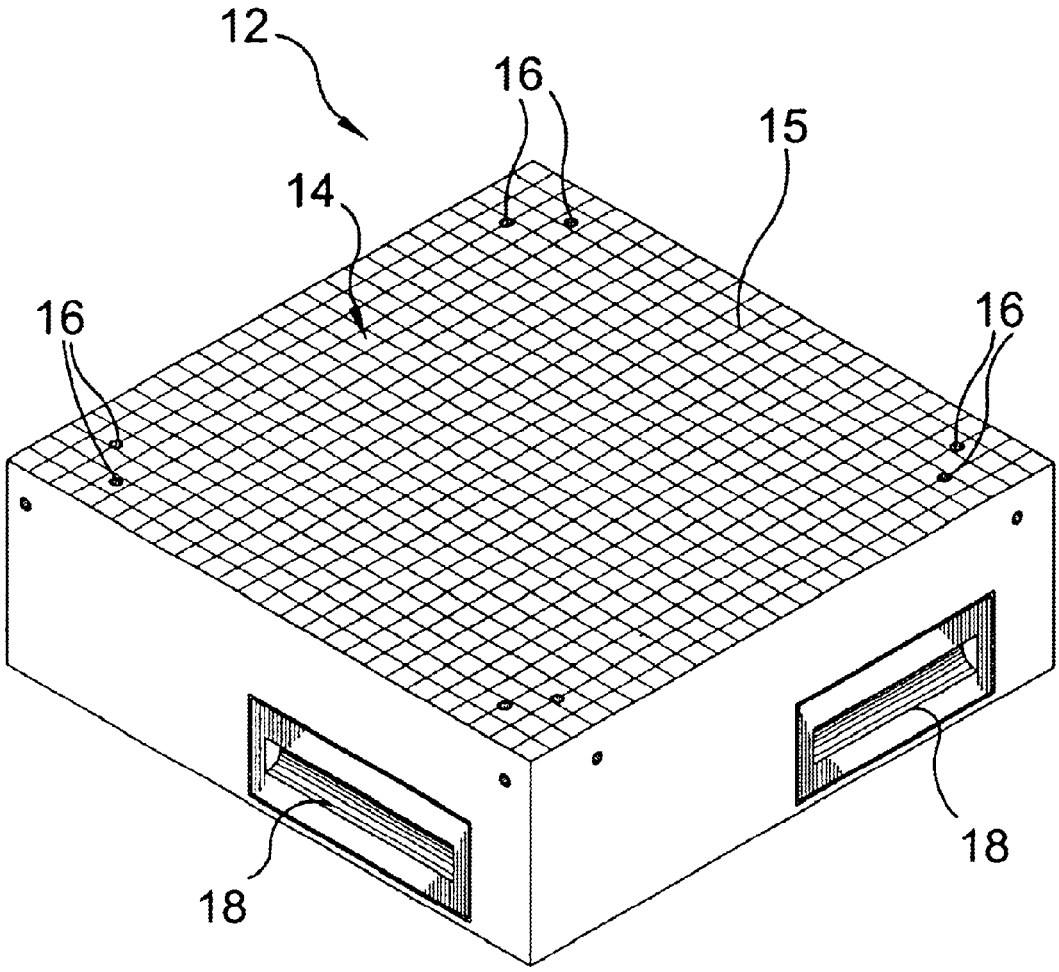
FIG. 2 is a perspective view of the board base.

FIG. 2 is a perspective view of the board base 12. The board base 12 is a box like structure of size complementing the inside surface of the frame of the table assembly where it is placed within, having a planar surface 14 with a grid 15 embossed thereon. Additionally the board base has storage drawers 18 with recessed handles built thereon for the storage and placement of game pieces. Pre drilled through bores 16 are supplied for assembly purposes.

Figure 3:
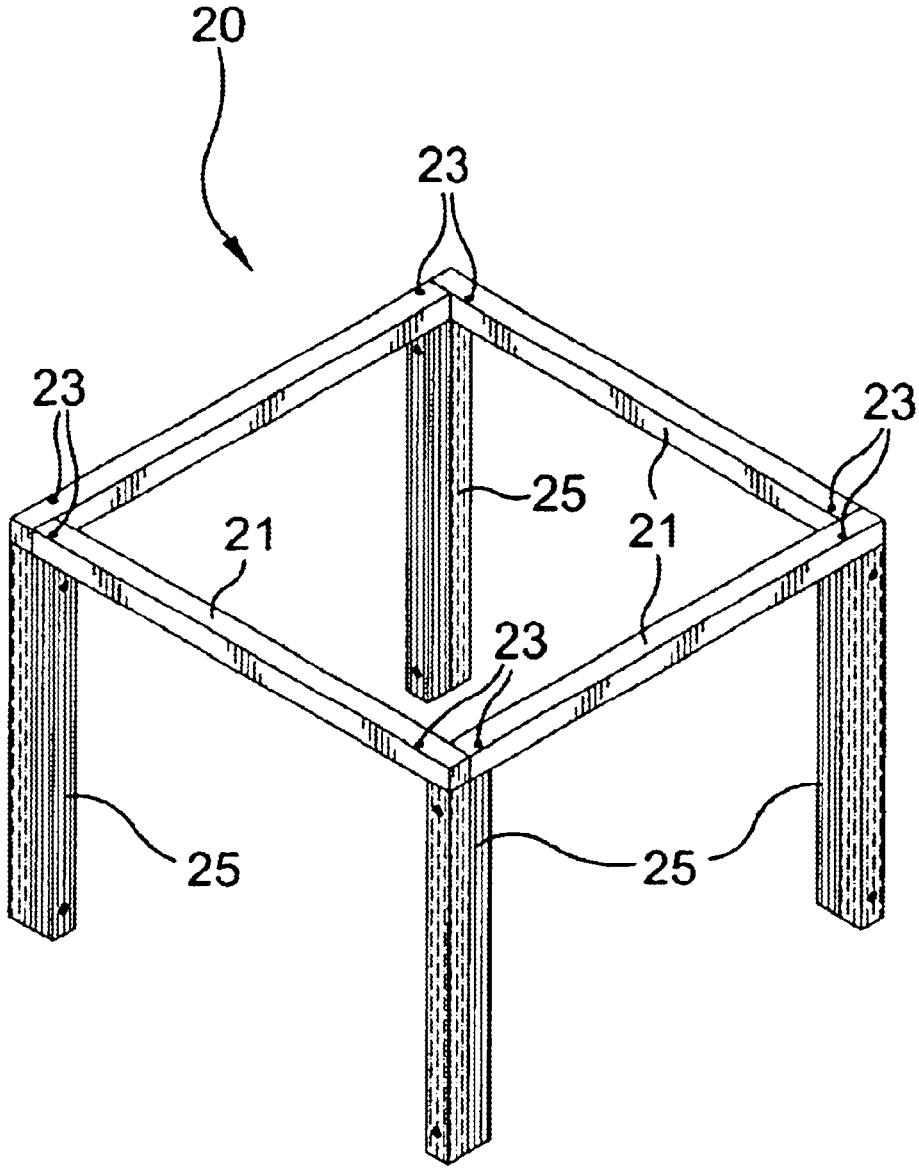
FIG. 3 is a perspective view of the table assembly.

FIG. 3 is a perspective view of the table assembly 20. The table assembly 20 has cross members 21 with through bores 23 and leg members 25 that form a frame for the placement of a board base 12 therein. Said table's legs 25 may be manufactured in a plurality of manners such as the legs 25 having a double structure, a half double leg structure, extension brace, or collapsible legs to provide a diversified plurality of placement options for one or more board assemblies.

Figure 4:
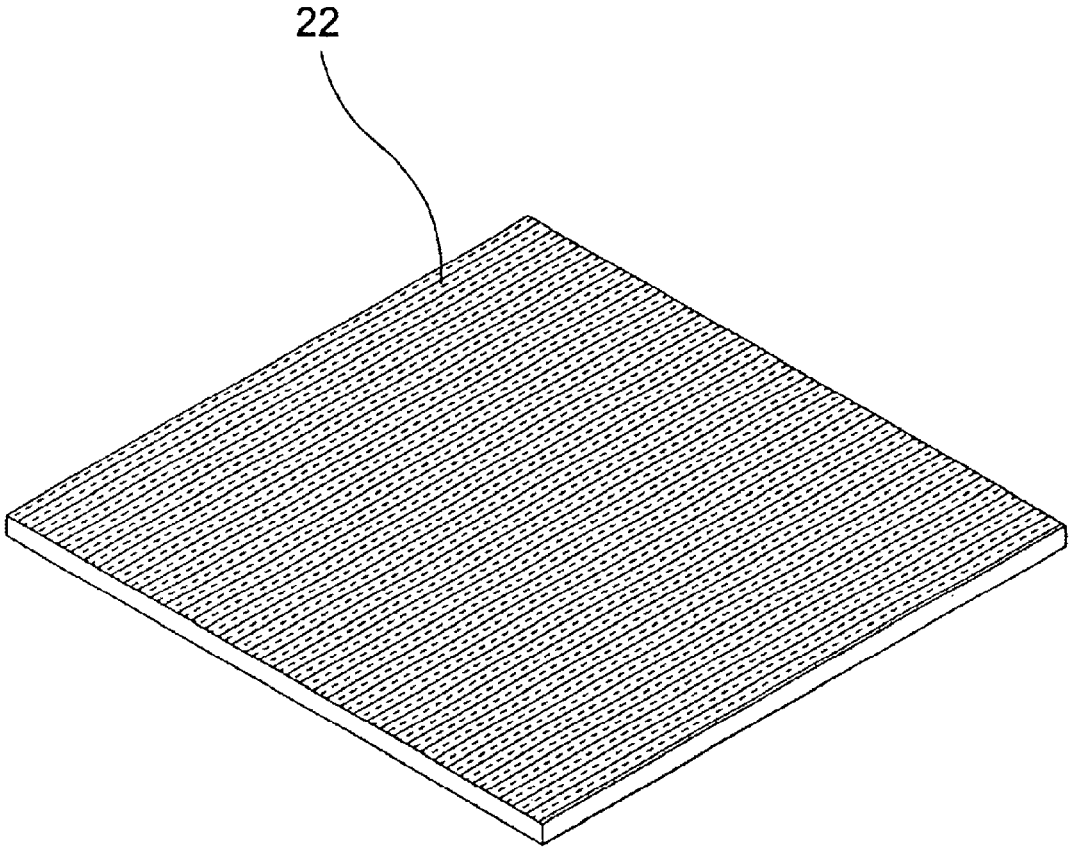
FIG. 4 is a top view of a thin plate.

FIG. 4 is a top view of a plate 22. The plate 22 is a sheet of material of varying size, shape, markings or color that may be rested on the table base or used to elevate the playing surface of the board base 12 by means of assorted game pieces. A full plate is made up of many thin plates 22 interconnected together vertically of horizontally to form a larger flat surface.

Figure 5:
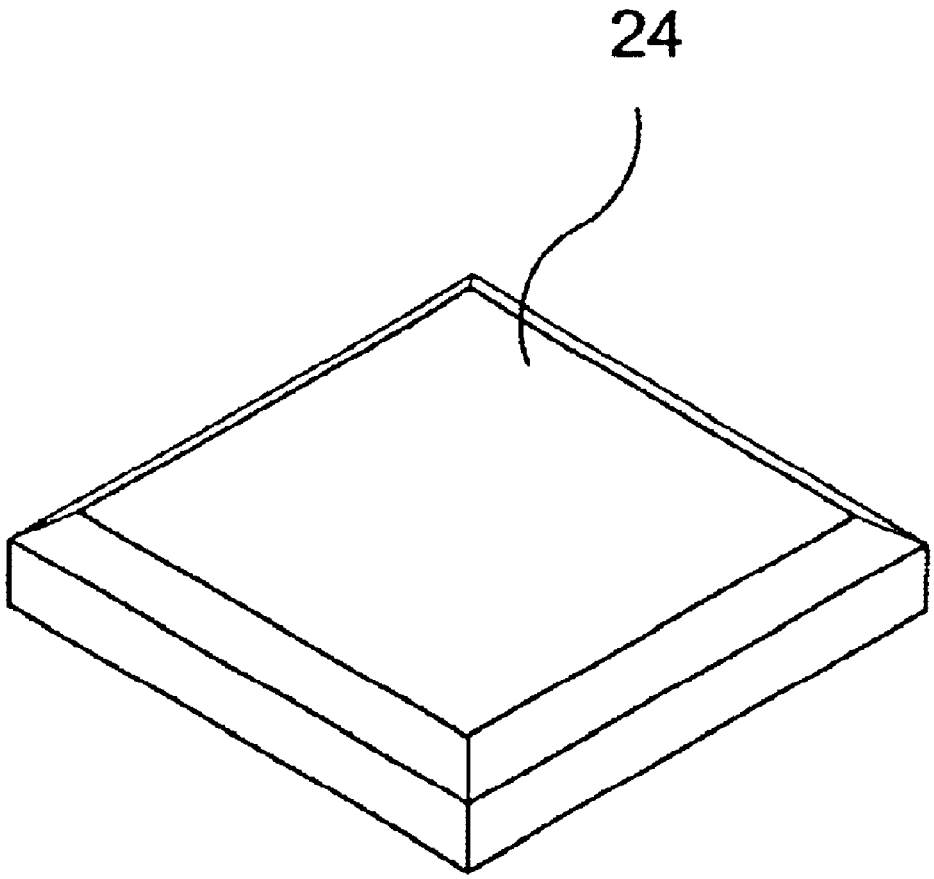
FIG. 5 is a perspective view of a pit.

FIG. 5 is a perspective view of a pit 24. Pits 24 are used as game pieces having a form similar to a game chip having varying colors, shapes, markings and sizes, used for playing a plurality of games.

Figure 6:
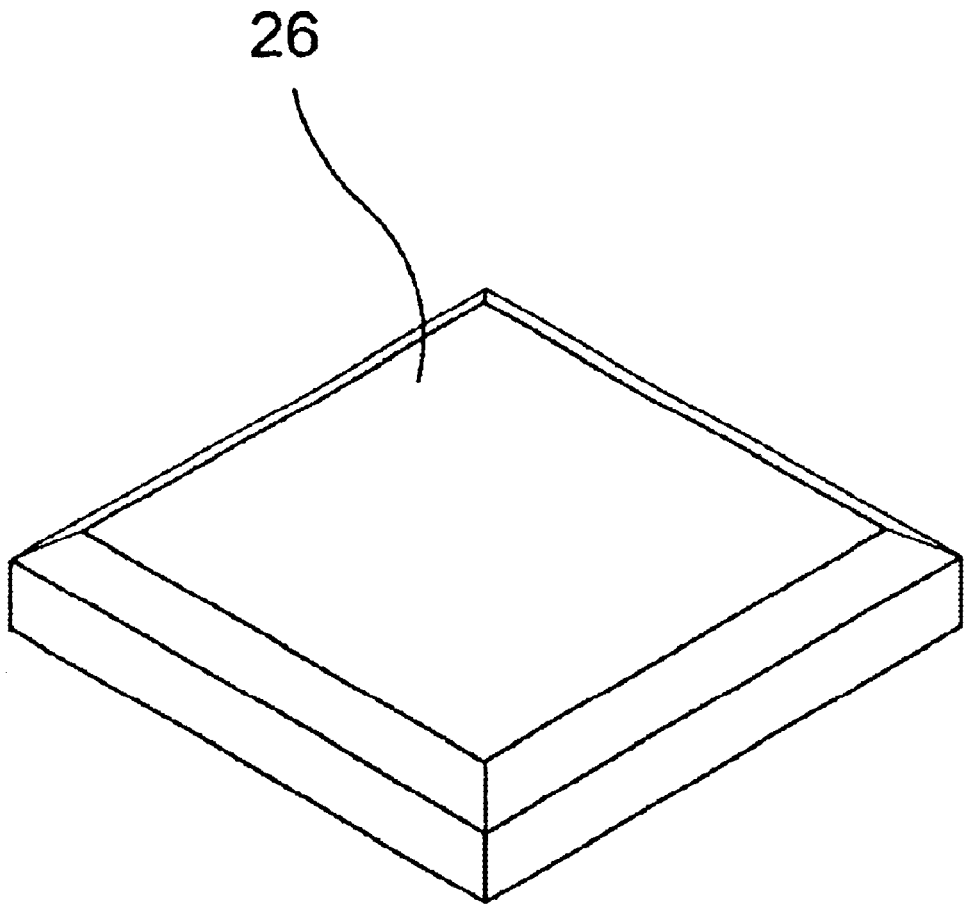
FIG. 6 is a perspective view of a pittance.

FIG. 6 is a perspective view of a pittance 26. Pittances 26 are game pieces similar to pits 24 but generally larger with varying color, shape, size and markings that are placed side by side in differentiating patterns and configurations to create a playing surface upon the board base 12.

Figure 7:
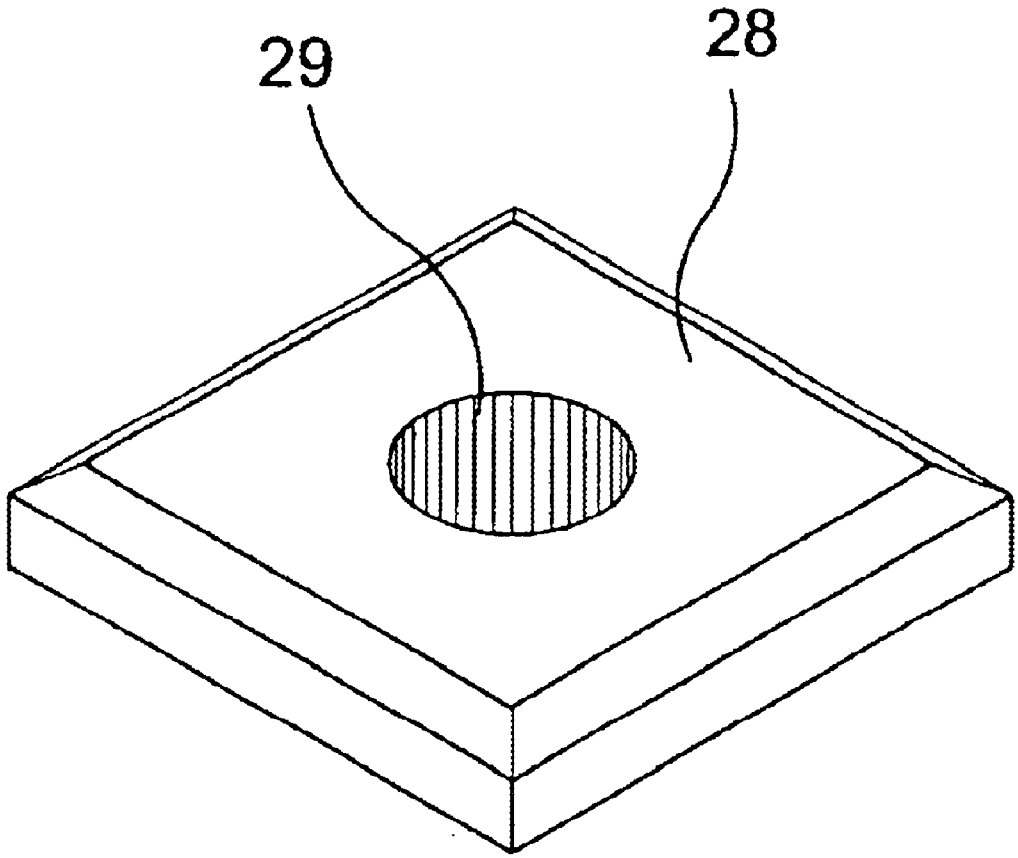
FIG. 7 is a perspective view of a single hole pittance.

FIG. 7 is a perspective view of a single hole pittance 28. Single hole pittances 28 are pittances having one recess 29 through which a peg or other distinguishing marker may be placed, or to allow screws or bolts to go through.

Figure 8:
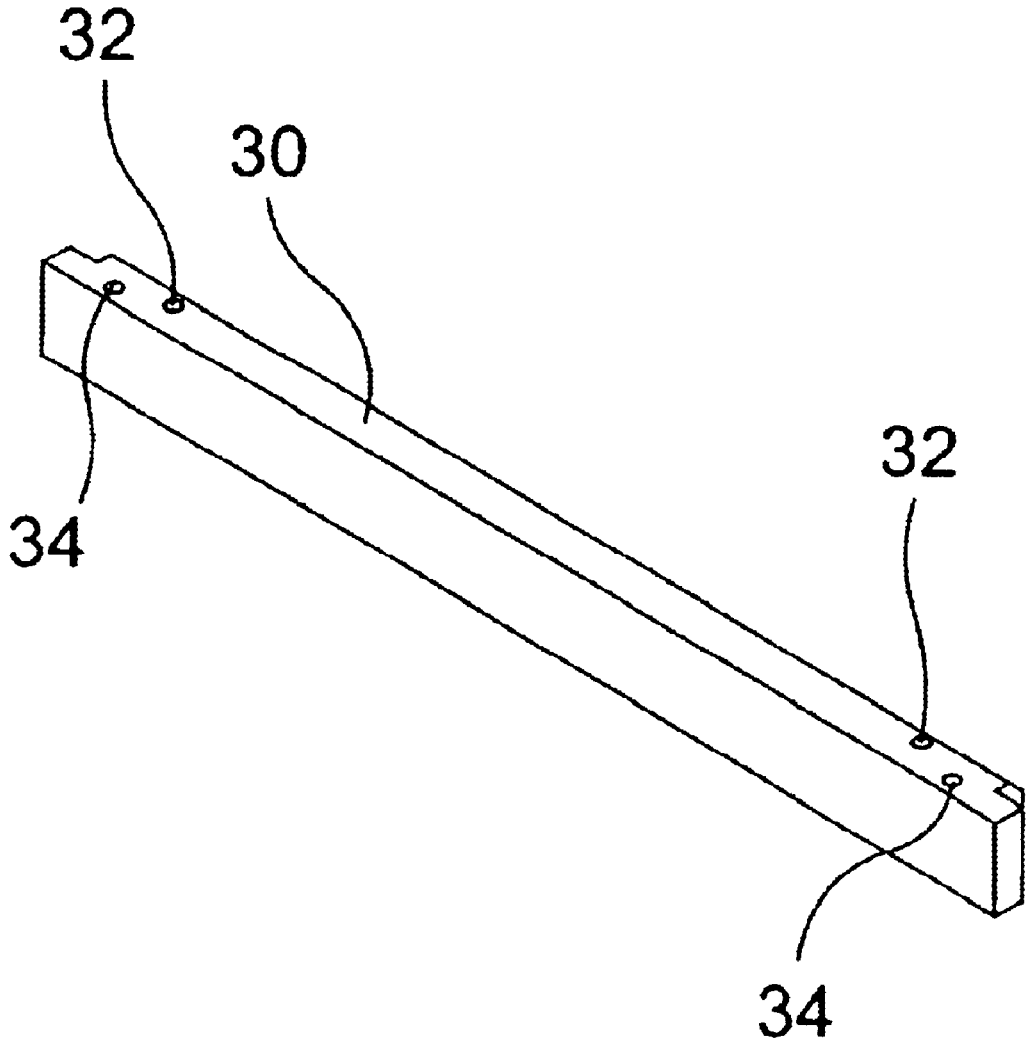
FIG. 8 is a perspective view of a board bound.

FIG. 8 is a perspective view of a board bound 30. The board bounds 30 are typically formed in an l-shaped structure whereby they may be fitted together and secured to an appropriate upper edge of the board base 12 to provide both a surrounding to the board base's 12 playing surface 14 and an attachment means for the board base 12 to the table and leg assembly 20. Board base recesses 32 are provided for fastening the board bound 30 to the board base 12 and table frame recesses 30 are provided for securing the board bounds 30 and their attached board base 12 to the table frame assembly 20.

Figure 9:
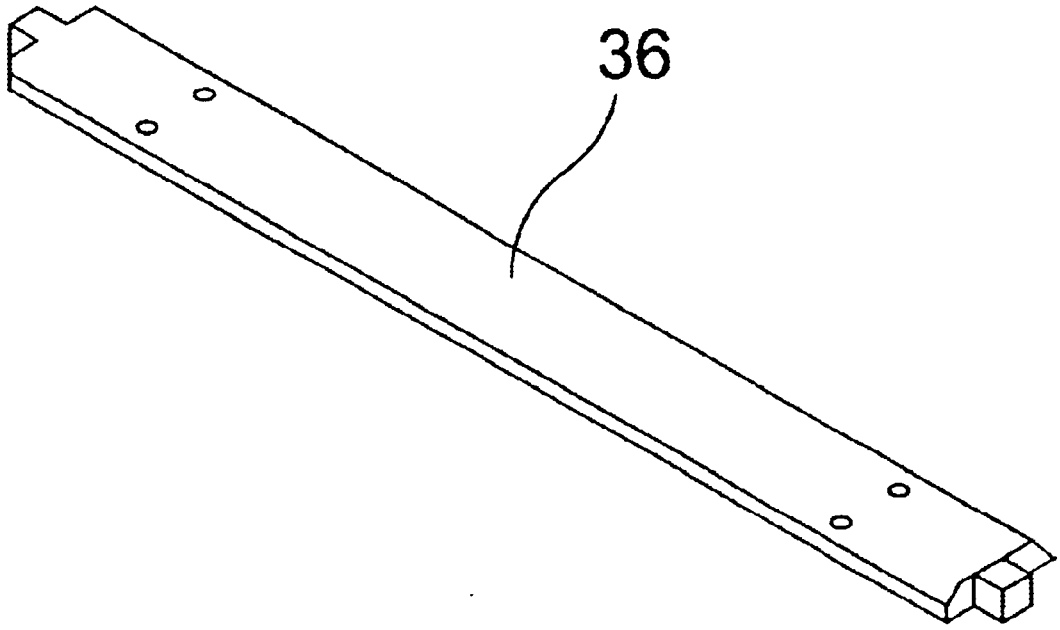
FIG. 9 is a perspective view of a ½ board bound.

FIG. 9 is a perspective view of a half board bound 36. Half board bounds 36 are the horizontal portion of the full board bound 30 described above. A half board bound 36 is an optional boundary used to divide one board base 12 surface when more than one board base 12 is interconnected.

Figure 10:
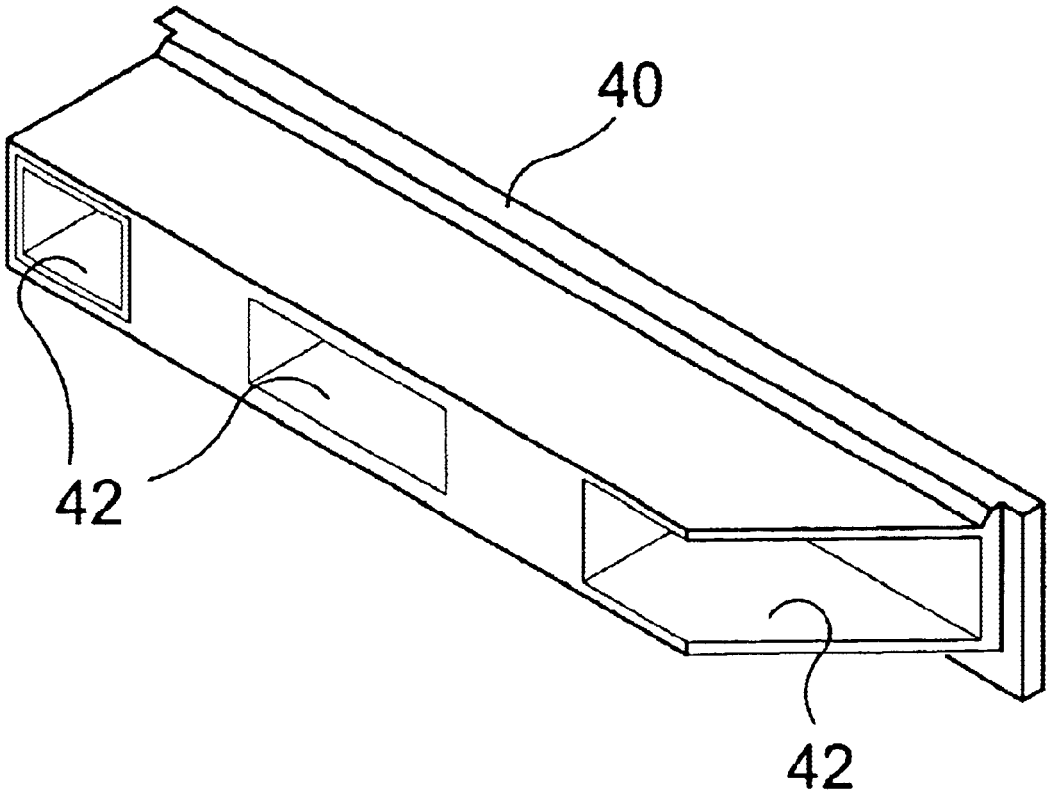
FIG. 10 is a perspective view of a pocket board bound.

FIG. 10 is a perspective view of pocketed board bound 40. Pocketed board bounds 40 are equipped with ½ pockets 42 at each corner and full pockets 42 in the center. The pockets 42 are used to insert pits 24.

Figure 11:
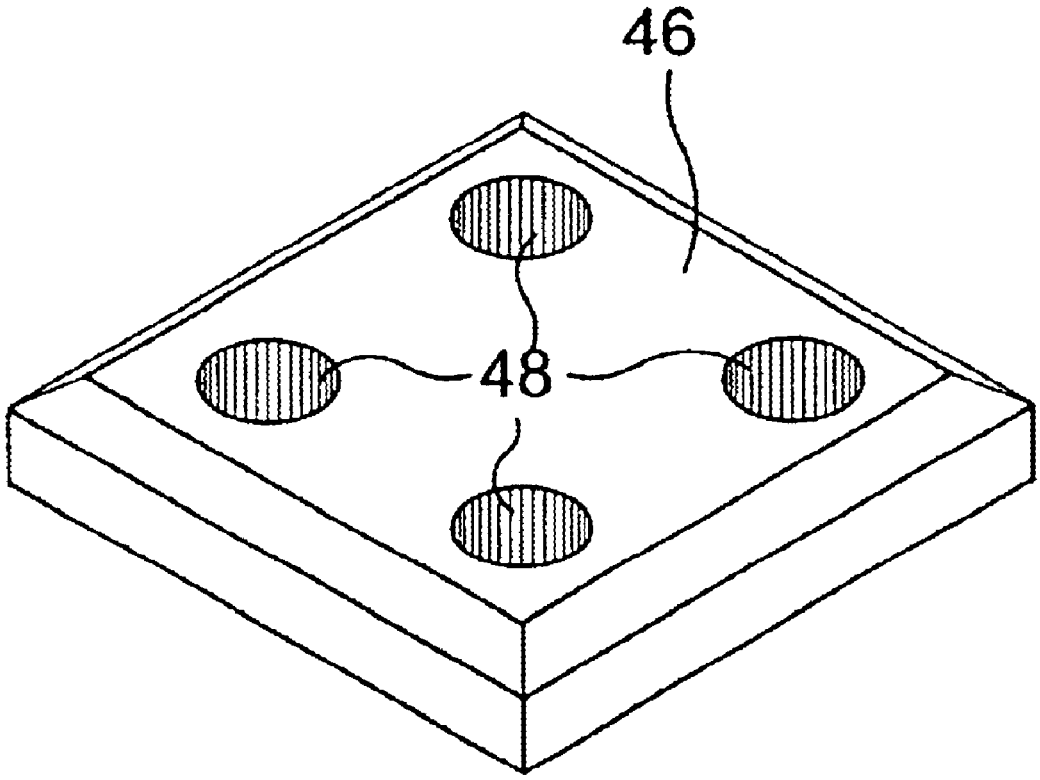
FIG. 11 is a perspective view of a pit-hole.

FIG. 11 is a perspective view of a pit hole 29. The pit-hole is a pit 24 or pittance 26 having one or more recesses 48 wherein a baguette may be placed to provide a marking to a game piece during play of certain games.

Figure 12:
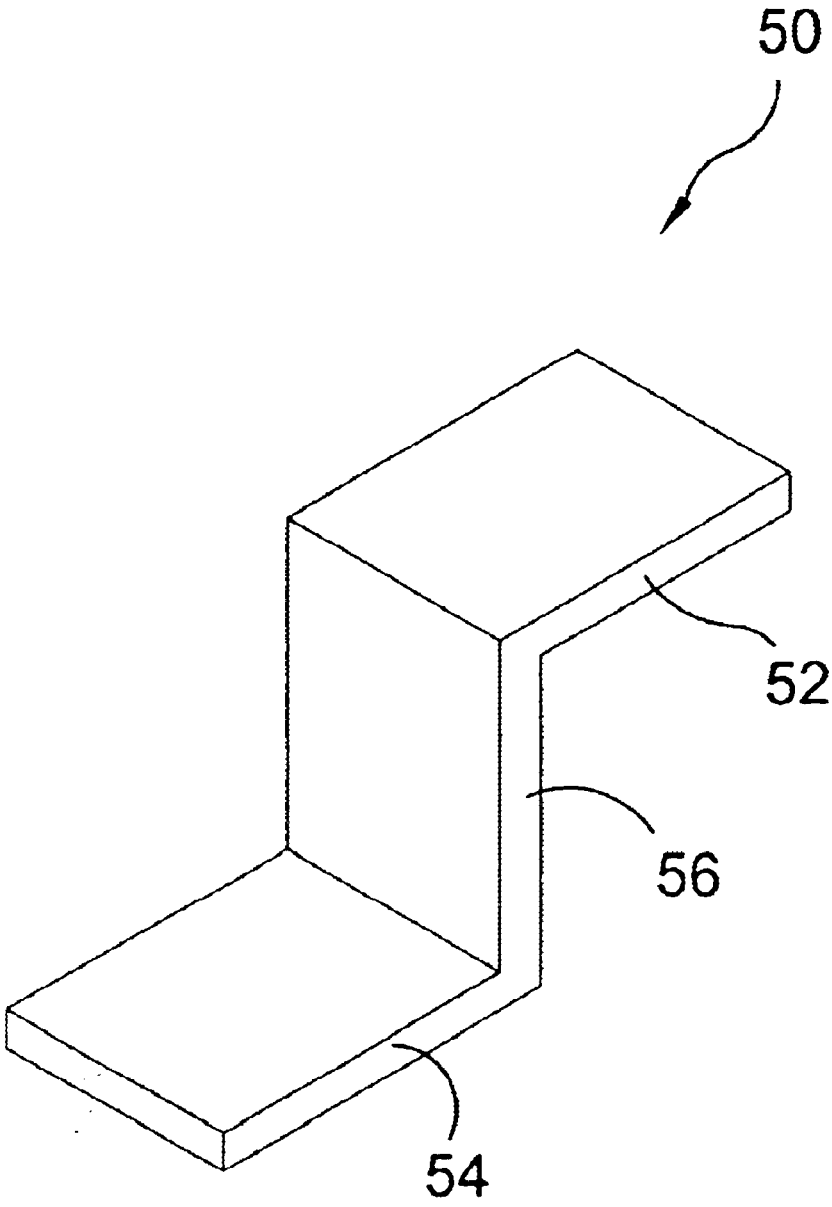
FIG. 12 is a side view of a lift piece.

FIG. 12 is a perspective view of a lift piece 50. Lift pieces 50 are construction pieces used to aid in lifting a pit 24, pittance 26, filler separator 70, or plate during certain games. The lift pieces 50 vary in size and provide a handle for lifting cornered pieces to accommodate the piece it is lifting. Each lift piece 50 has an upper plate 52 and a base plate 54 inter connected on opposing distal ends and sides of a vertical plate 56.

Figure 13:
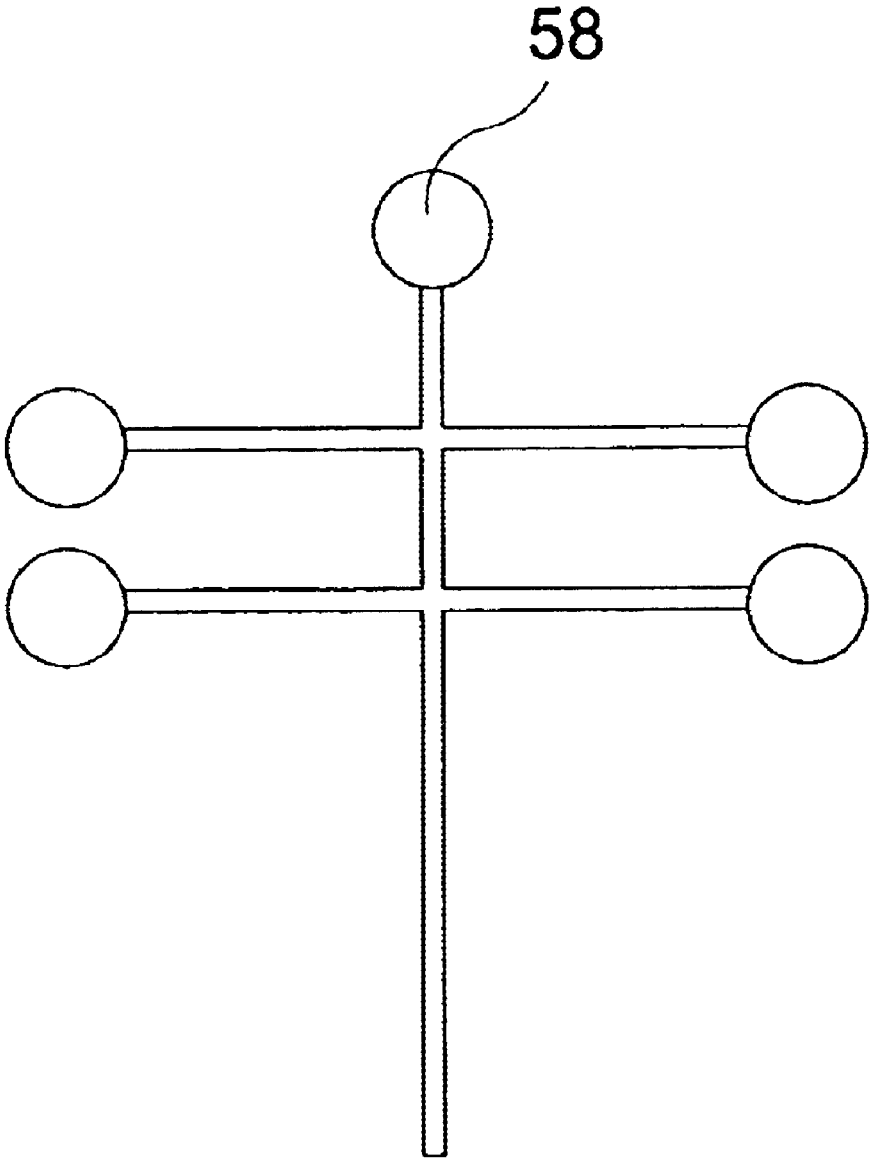
FIG. 13 is a side view of a baguette (pit-pole).

FIG. 13 is a perspective view of a baguette 58. Baguettes 58 or pit-poles are game pieces having the form of a peg that may be inserted into pit-holes 46 during game play.

Figure 14:
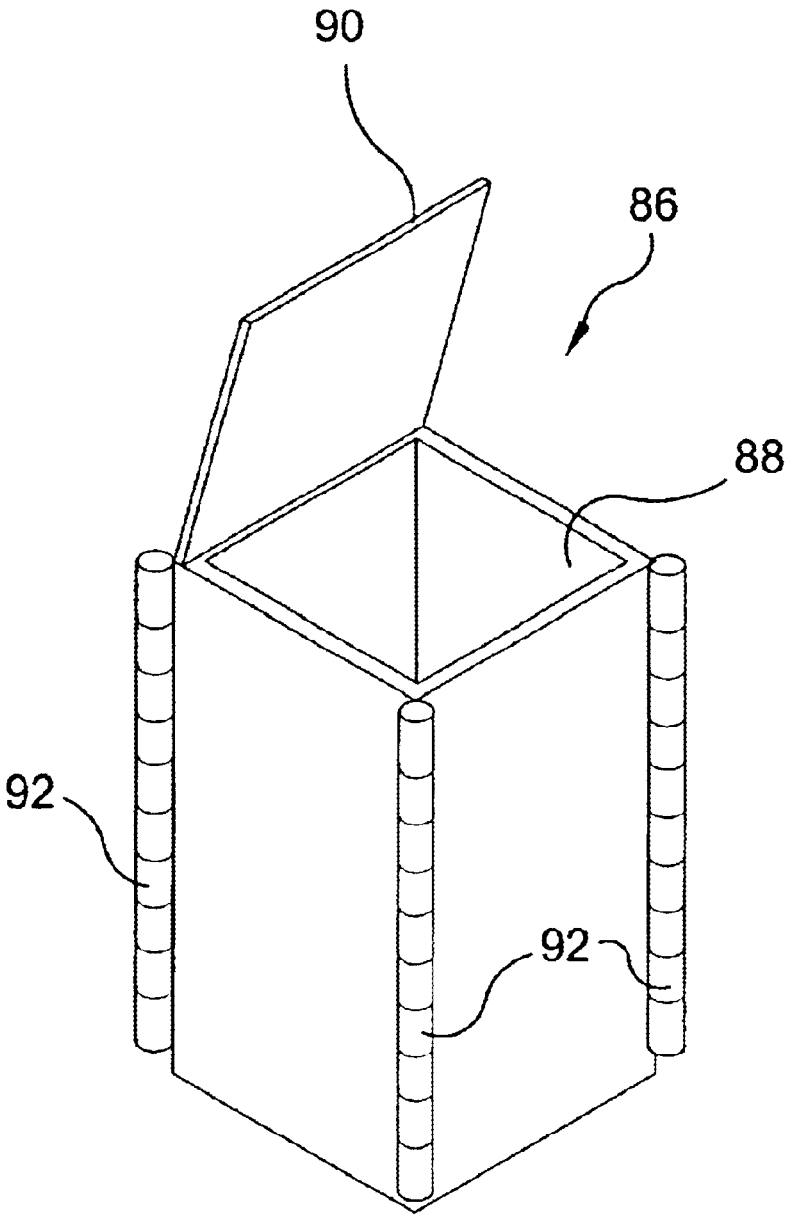
FIG. 14 is a perspective view of a freezer.

FIG. 14 is a perspective view of a freezer 86. The freezer 86 is a game piece having a box like shape with a lid 90 that may be assembled and disassembled to provide an area for discarded or out of use game pieces during game play. Four sidewalls 88 are connected by hinges 92. The hinged assembly allows the freezer to be broken down into flat plates for storage.

Figure 15:
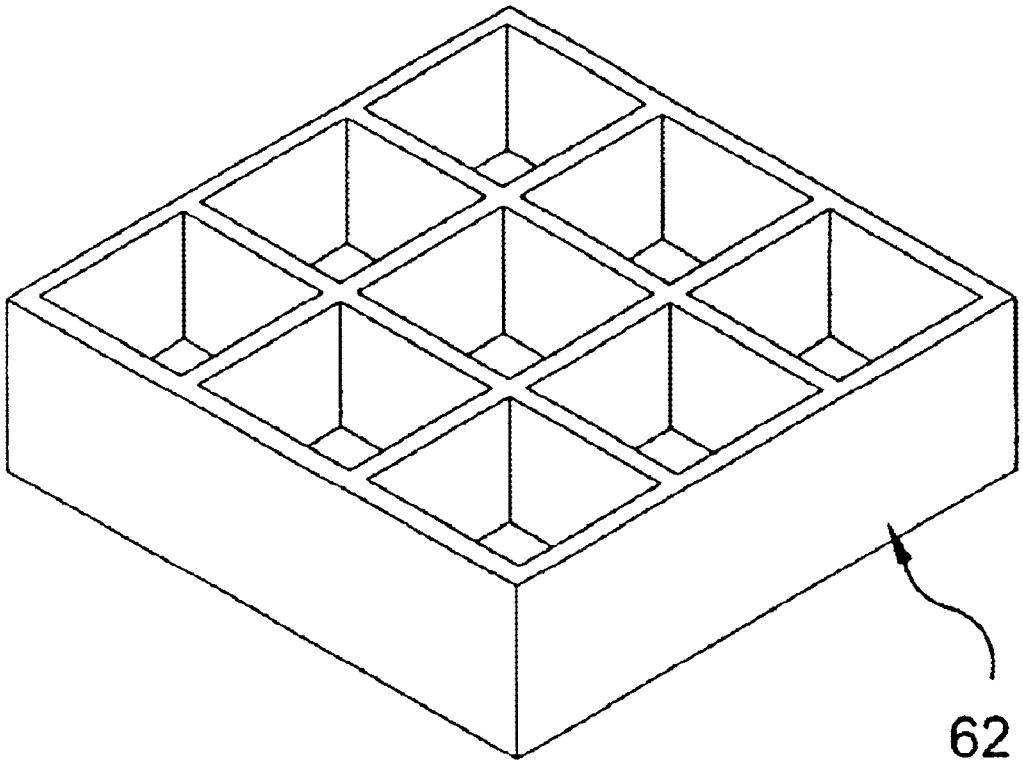
FIG. 15 is a perspective view of a molded draw insert.

FIG. 15 is a perspective view of a molded drawer insert 62. Shown is a molded draw insert 62 that can be placed in one or more of the board base's drawers 18 to help organize and hold game pieces until use. The molded draw insert 62 may vary in shape and style to suit the game pieces utilized.

Figure 16:
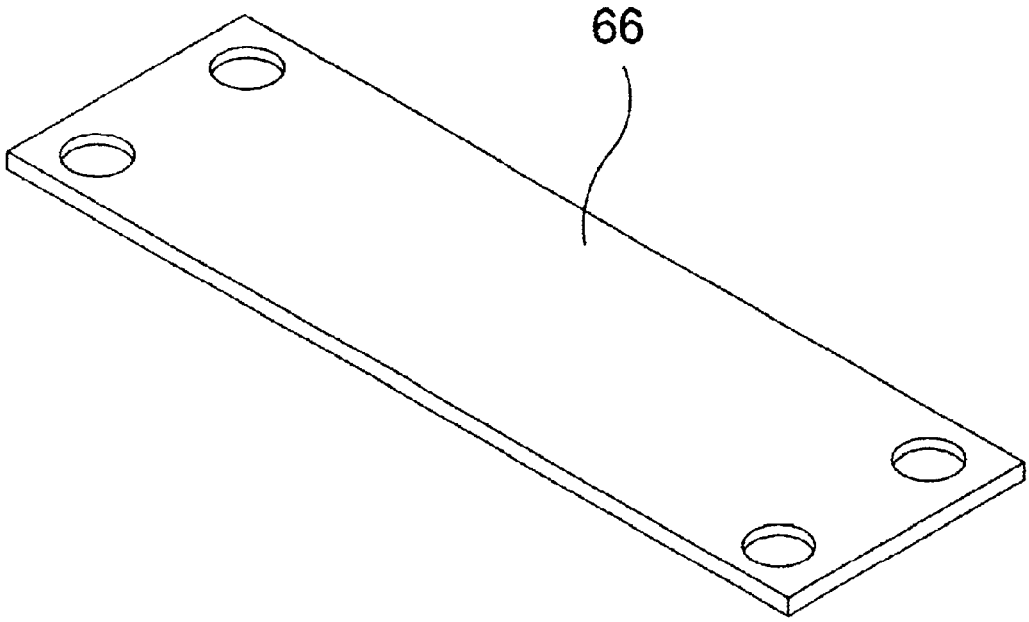
FIG. 16 is a perspective view of a brace.

FIG. 16 is a perspective view of a brace 66. In order to create larger playing surfaces a plurality of table assemblies and board bases 12 may be combined together by usage of a plurality of braces 66 mounted between said board base's 12. Additionally a full table may be produced for other purposes than game play by using a plurality of plates.

Figure 17:
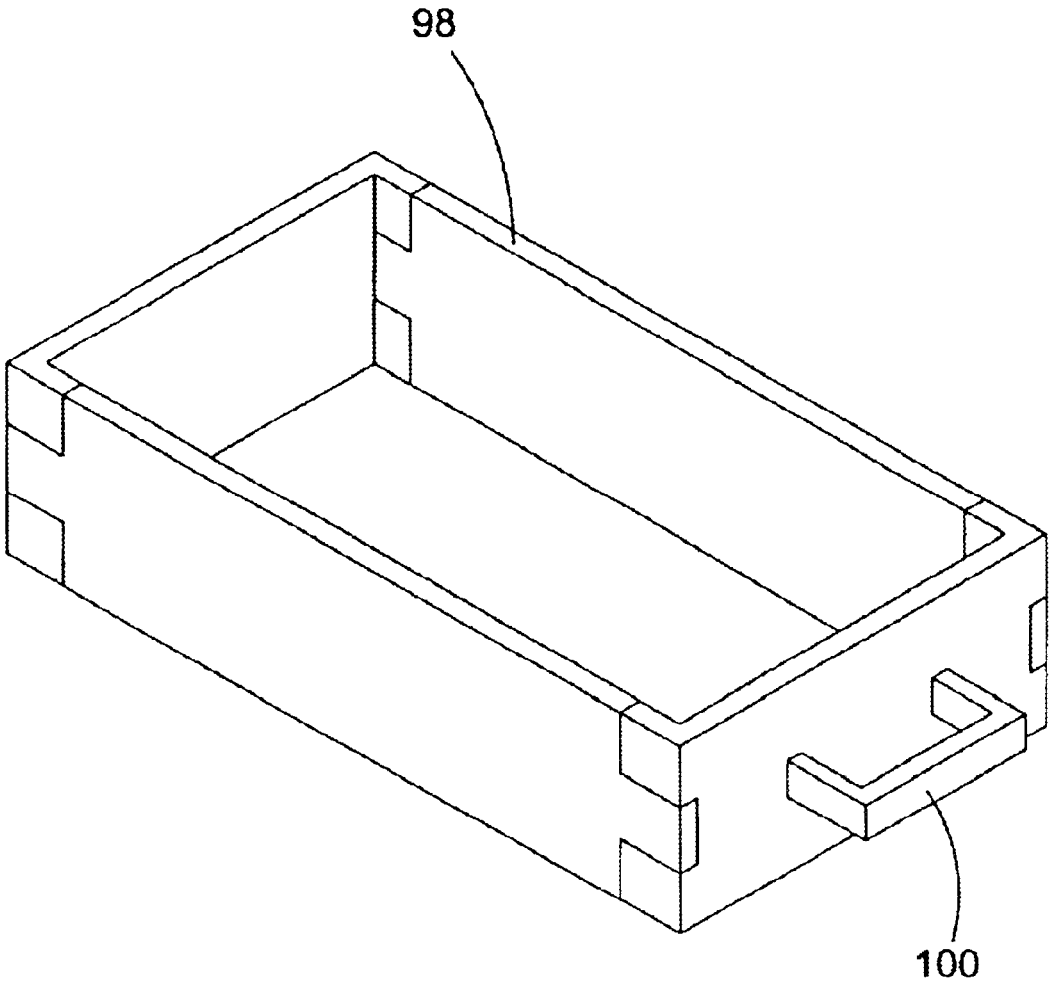
FIG. 17 is a perspective view of a carrying wrap.

FIG. 17 is a perspective view of a carrying wrap 98. The carrying wrap 98 is a 4 piece structure consisting of four sides. Pegs slid into the hinges connecting the pieces together. Convex bits on the inside of the 4 side pieces keep the carrying wrap 98 secure during transport. Additionally one of the carrying wraps 98 side are equipped with a handle 100 to make for easier carrying of the contained board base 12.

Figure 18:
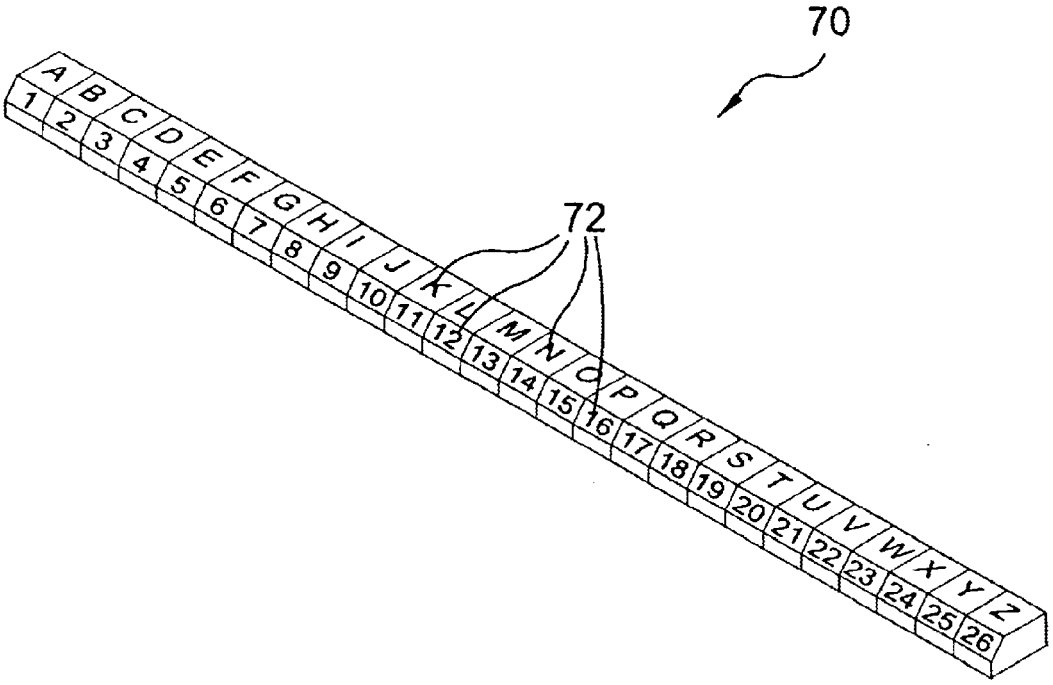
FIG. 18 is a perspective view of a separator.

FIG. 18 is a perspective view of a filler separator 70. Filler separators 70 may or may not contain indicia 72 on top or on the inner facing vertical side and are used as board marker holders or for creating a smaller board surface.

Figure 19:
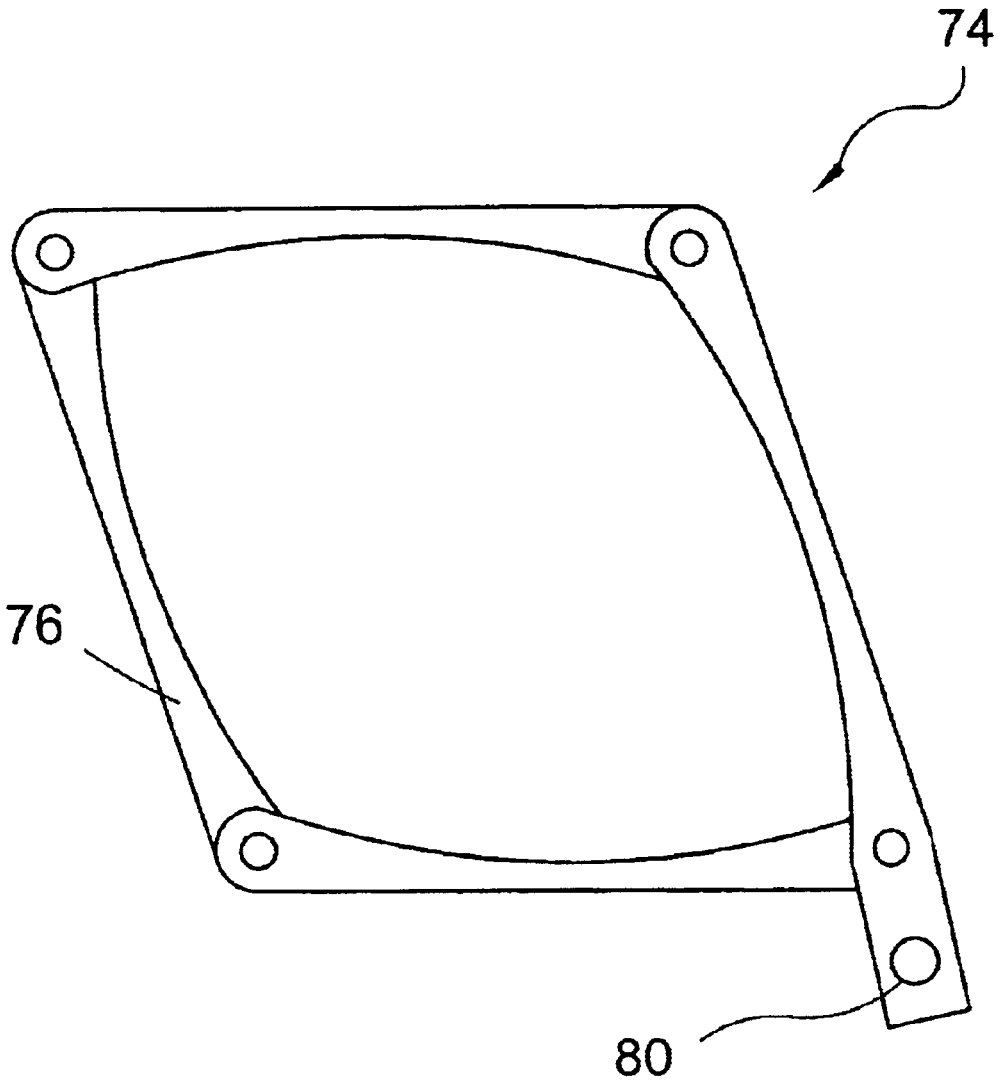
FIG. 19 is a perspective view of a cup holder.

FIG. 19 is a perspective view of a collapsible cup holder 74. The cup holder is hinged in a manner that will permit it to hold containers of varying diameters. Furthermore, the cup holder 74 may fold away flush to board base when not in use.

Figure 20:
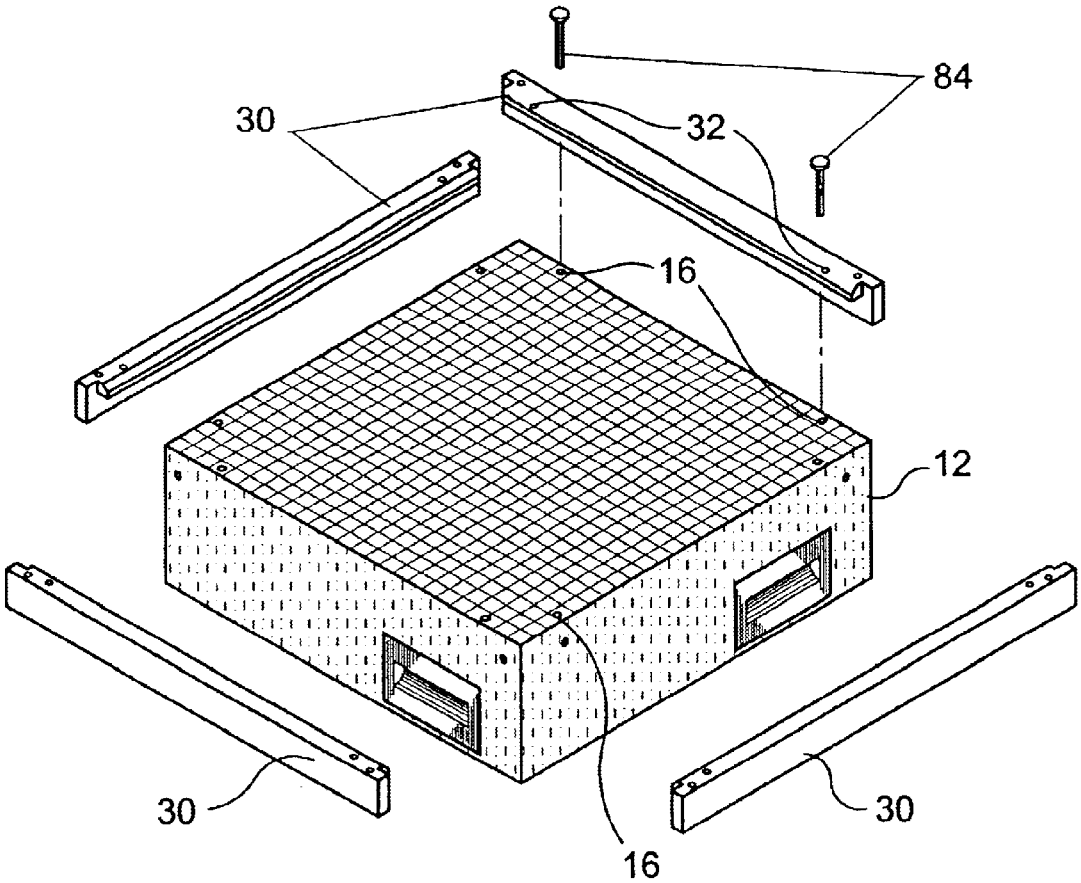
FIG. 20 is an exploded perspective view of the present invention.

FIG. 20 is an exploded view of the present invention.

FIG. 20 illustrates the board base 12 having a plurality of board bounds 30 being attached by fasteners 84 to the four sides of the table base's upper edges. The board bounds 30 produce both a surface where the table base rests upon the cross members 22 of the frame and a boundary and limiting factor to the available playing surface of the board base 12.

Figure 21:
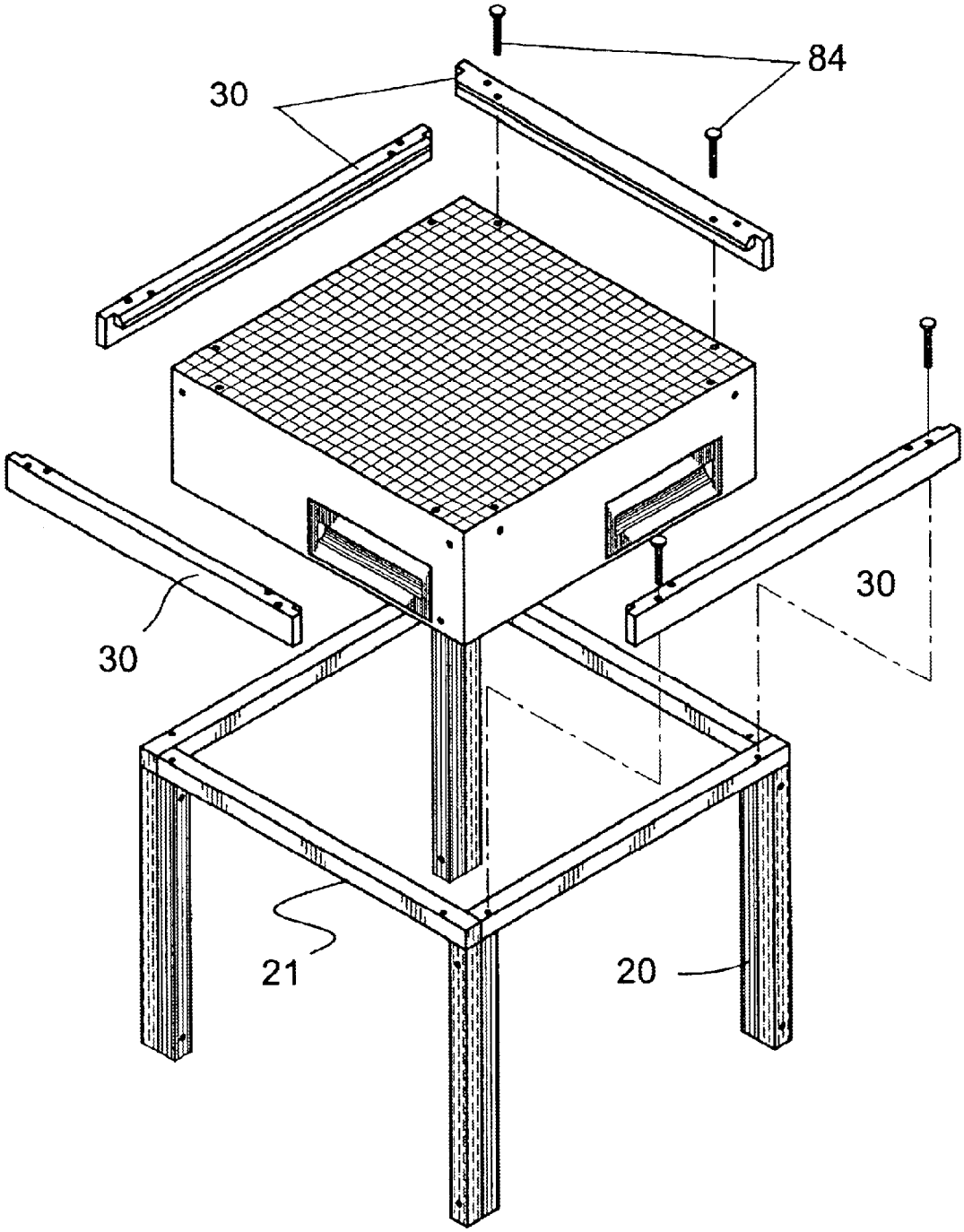
FIG. 21 is an exploded perspective view of the present invention.

FIG. 21 is an exploded view of the present invention 10 showing the assembly of the board bounds 30 to the board base 12 and the board base 12 to the frame assembly 20. When the board bounds 30 are attached to the board base a flange is created around the upper side perimeter of the board base 12 that rests upon the cross members 21 and then attached thereto.

Figure 22:
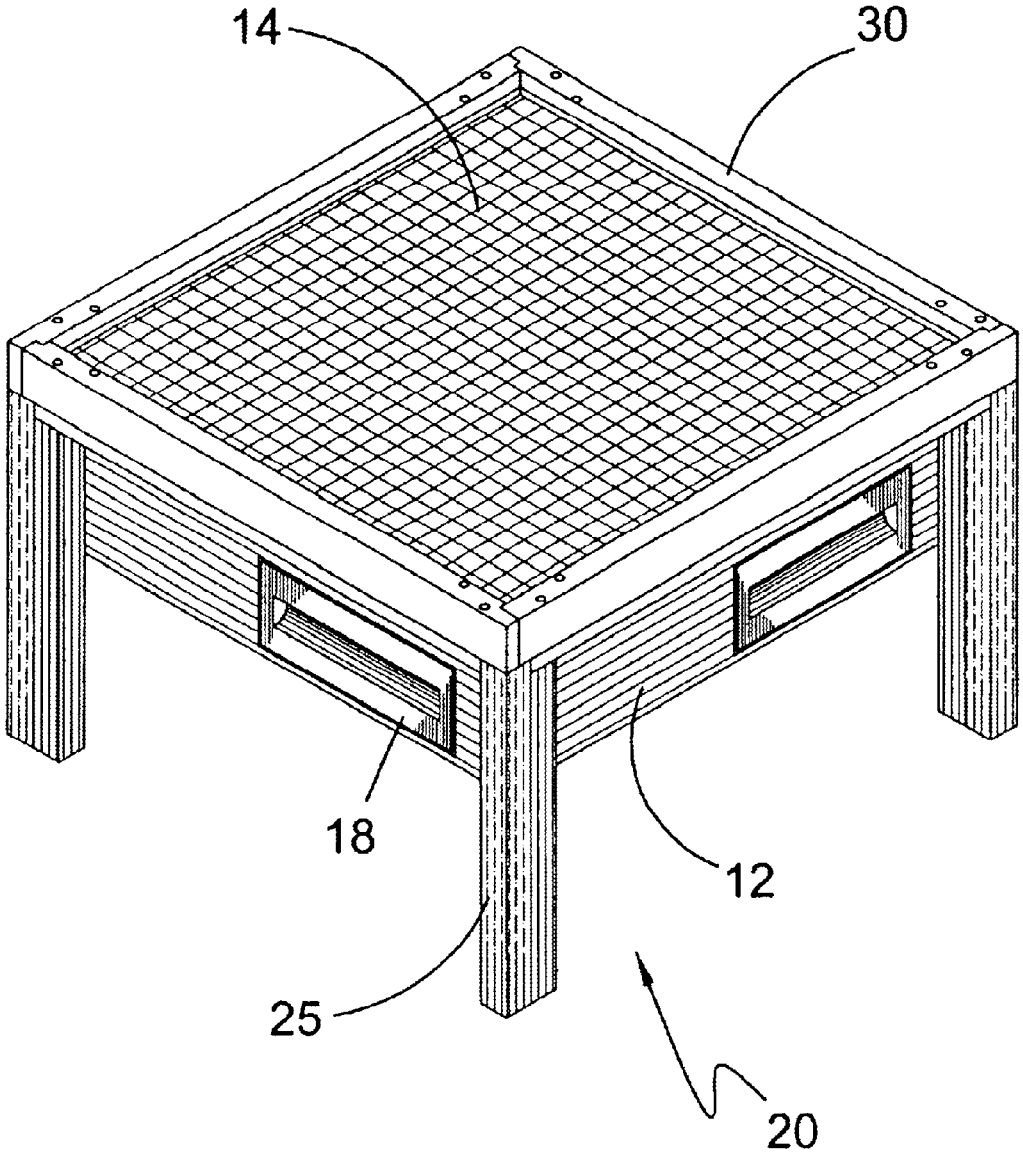
FIG. 22 is a perspective view of the present invention.

FIG. 22 is a perspective view of the present invention 10 showing the present invention 10 fully assembled to form a free standing fully customizable game board having accessible storage drawers 18 and an embossed grid on its playing surface 14 for the placement of game pieces thereon.

Figure 23:
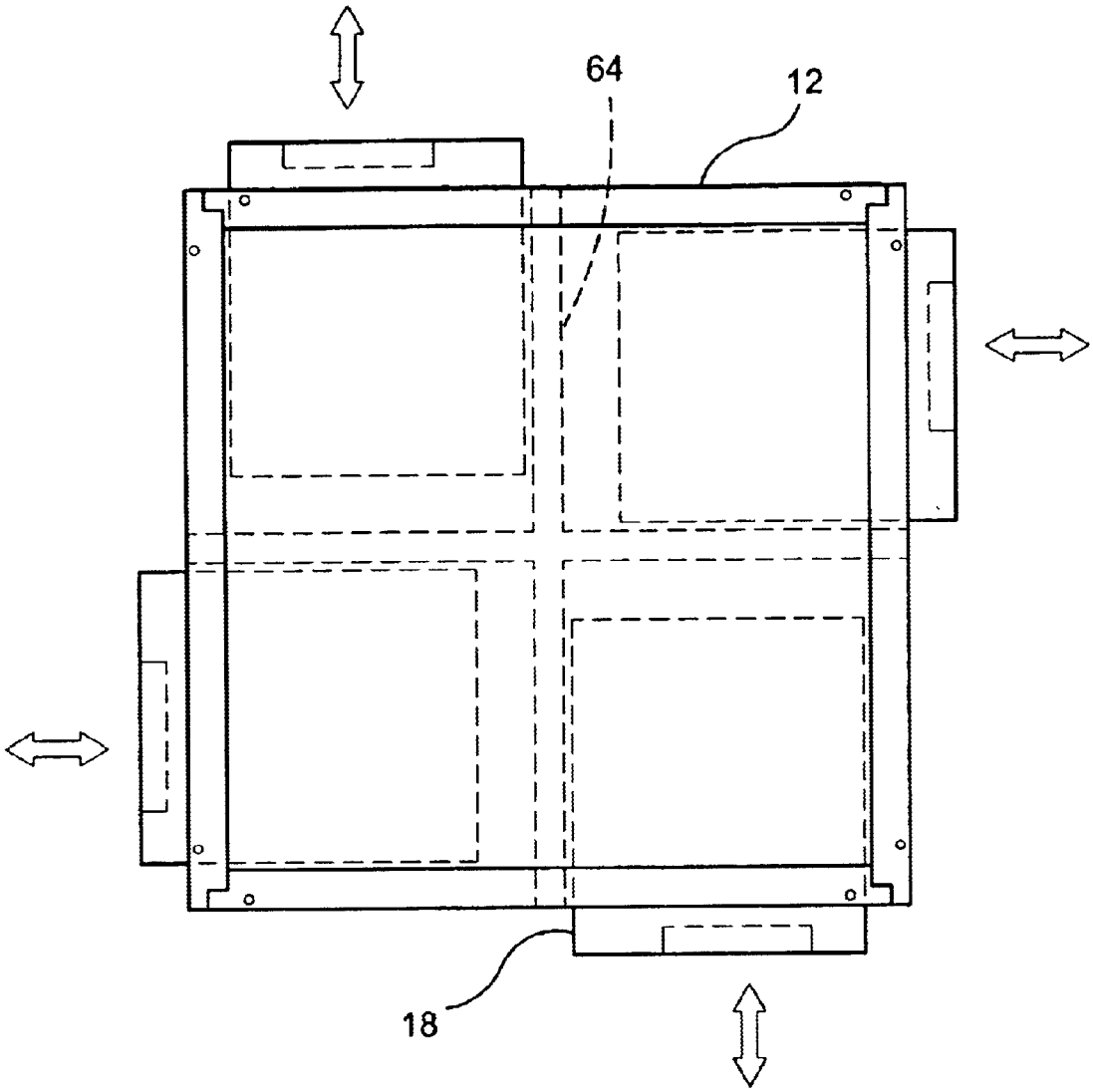
FIG. 23 is a bottom view of the table base.

FIG. 23 is a bottom view of the board base 12 showing the drawer layout in the board base 12 of the present invention 10. The drawers 18 are equal in size and are positioned in each quadrant at the right-hand side of the table's four vertical surfaces. The drawer 18 is opened and closed using a flush style handle located in the middle of the front surface. The drawers 18 include molded inserts 64 that organize the game and board components while not in use. The under side of the table base contains slots for storing parts like filler separators and/or the carrying wrap flat pieces.

Figure 24:
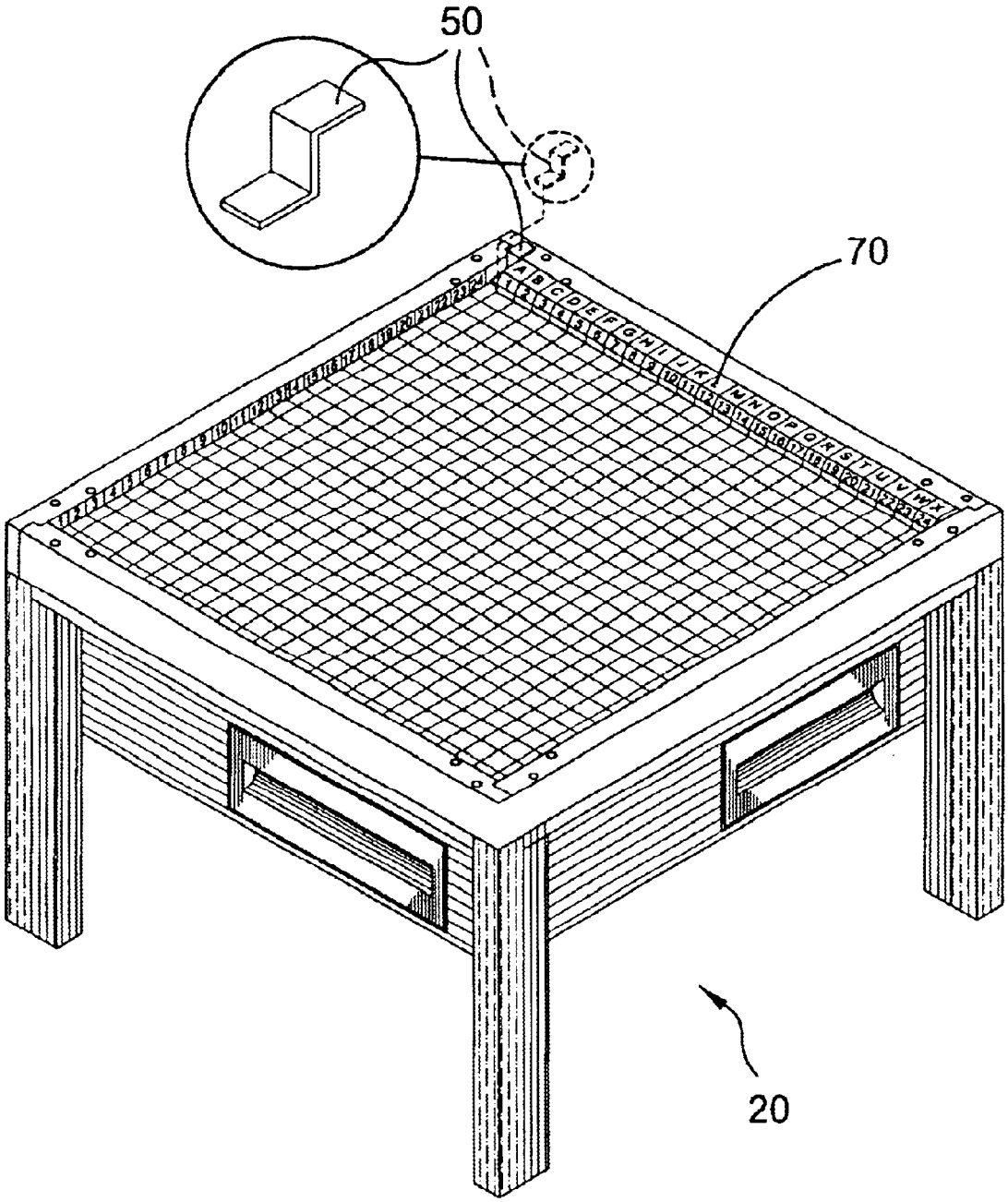
FIG. 24 is a perspective view of the present invention.

FIG. 24 is a perspective view of the present invention showing the components of the present invention 10. The filler separators 70 are used to diminish the size of the table base playing surface. A filler separator 70 may contain many different attributes including different colors, markings, and/ or shapes. Lift pieces 50 are used to elevate the playing surface or other games pieces such as pits 24 or pittances 26. Thin plates 22 are used to section the table base for game requirements. Thin plates 22 may be interlocked together vertically or horizontally to make up a full plate and may consist of various colors and/or markings as determined by the game requirements.

Figure 25:
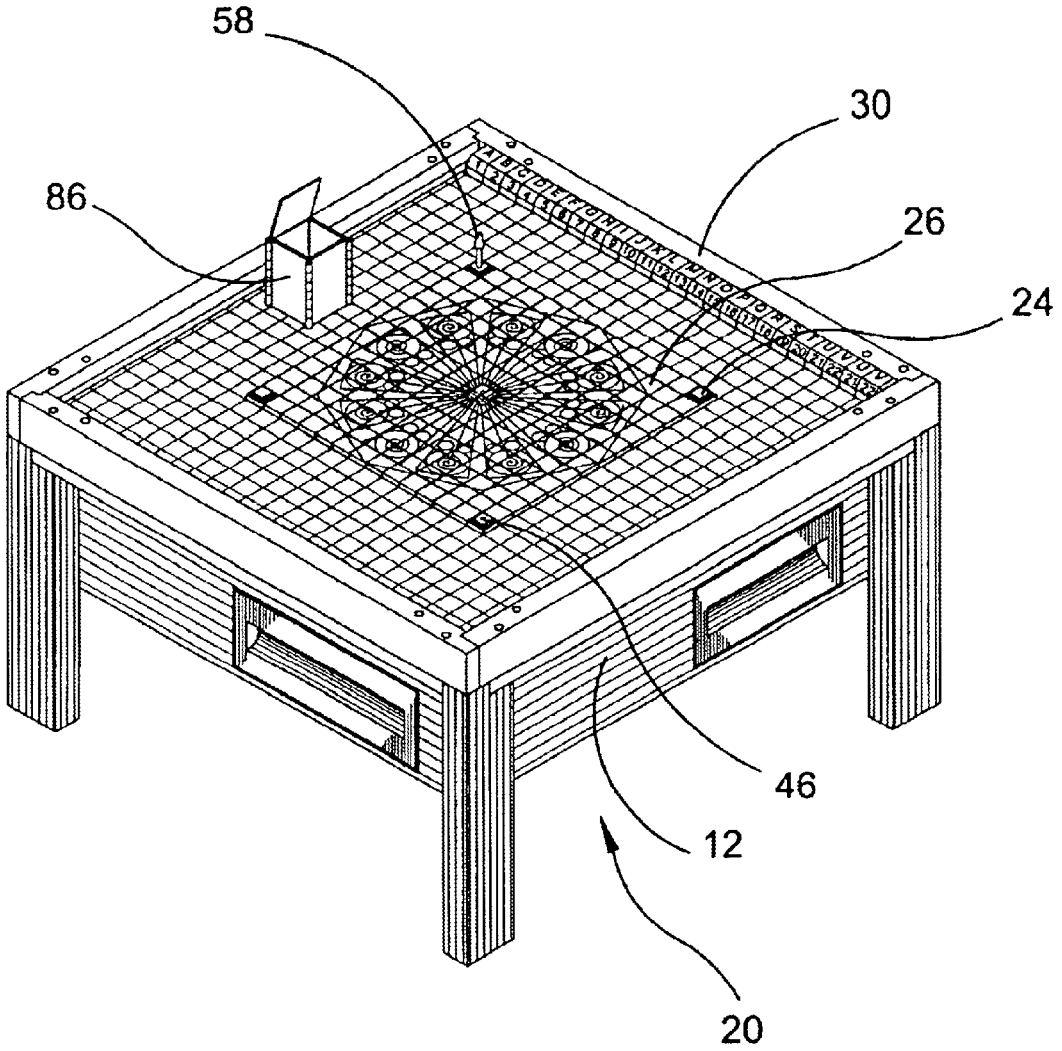
FIG. 25 is a perspective view of the present invention.

FIG. 25 is a perspective view of the present invention 10 showing the components of the present invention in use. The pittance pieces 26 are assembled in a pattern to create the playing surface. Pittance 26 may vary in size shape color and markings. Pits 24 are used as game pieces having a form similar to a game piece. Pits 24 may vary in size shape, color, markings or contain through hole patterns described as pit-hole. Pit-hole pieces 46 may contain one or more through bores 48 and may vary in attributes as the standard pit 24. The pit-hole 46 pieces are used to insert peg form pieces described as baguette or pit-pole pieces 58 during game play. The freezer 86 is used to store discarded game pieces during game play.

Figure 26:
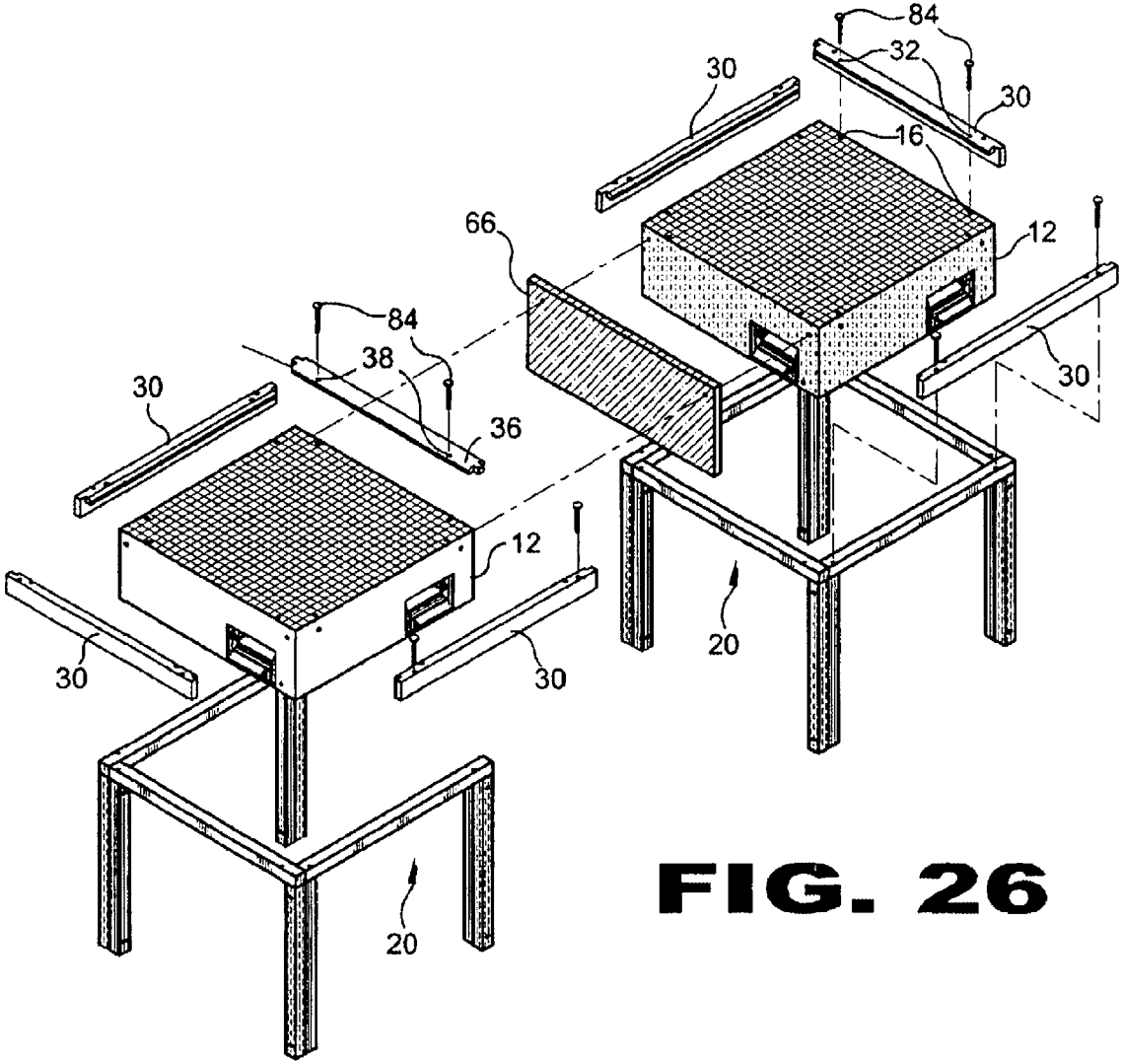
FIG. 26 is an exploded perspective view of the present invention.

FIG. 26 is an exploded view of the present invention 10 when connecting more than one table assembly 20 together, the table assemblies 20 are interconnected by means of an extension brace 66. The brace 66 can be substituted for the leg assembly. The top surface of the brace is etched with the same grid pattern as the table base and is secured through the sides of the table base such that its top surface is flush with the top of the table base creating an extended playing area. If desired the playing area can by sectioned by mounting a half board bound 36.

Figure 27:
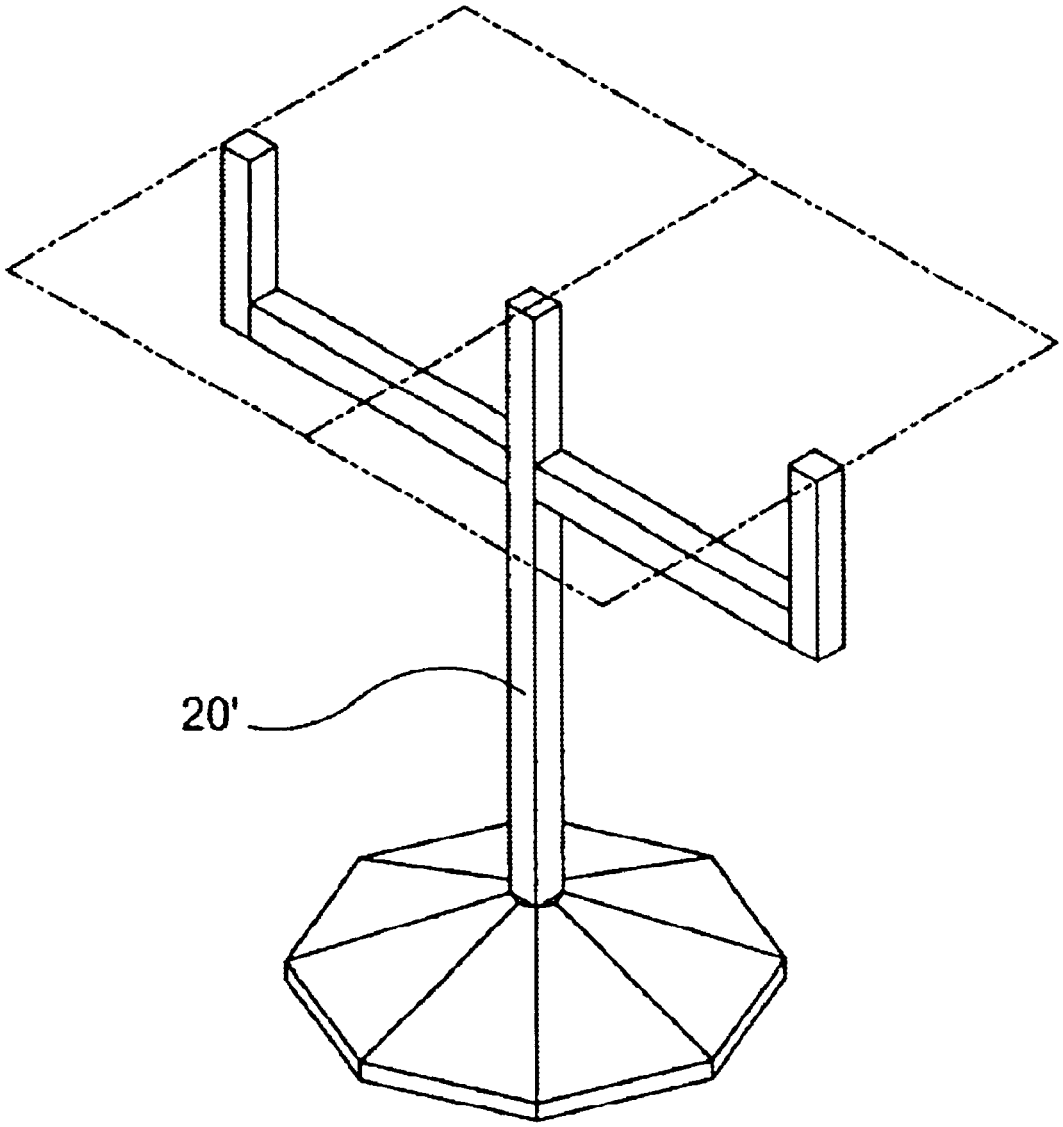
FIG. 27 is an alternate embodiment of the table assembly.

FIG. 27 is an alternate embodiment of the table assembly 20'. Table frames and their support structures may be used to accommodate for the practicality of the use of more than one board. The table shown is sized to receive two boards simultaneously.

Figure 28:
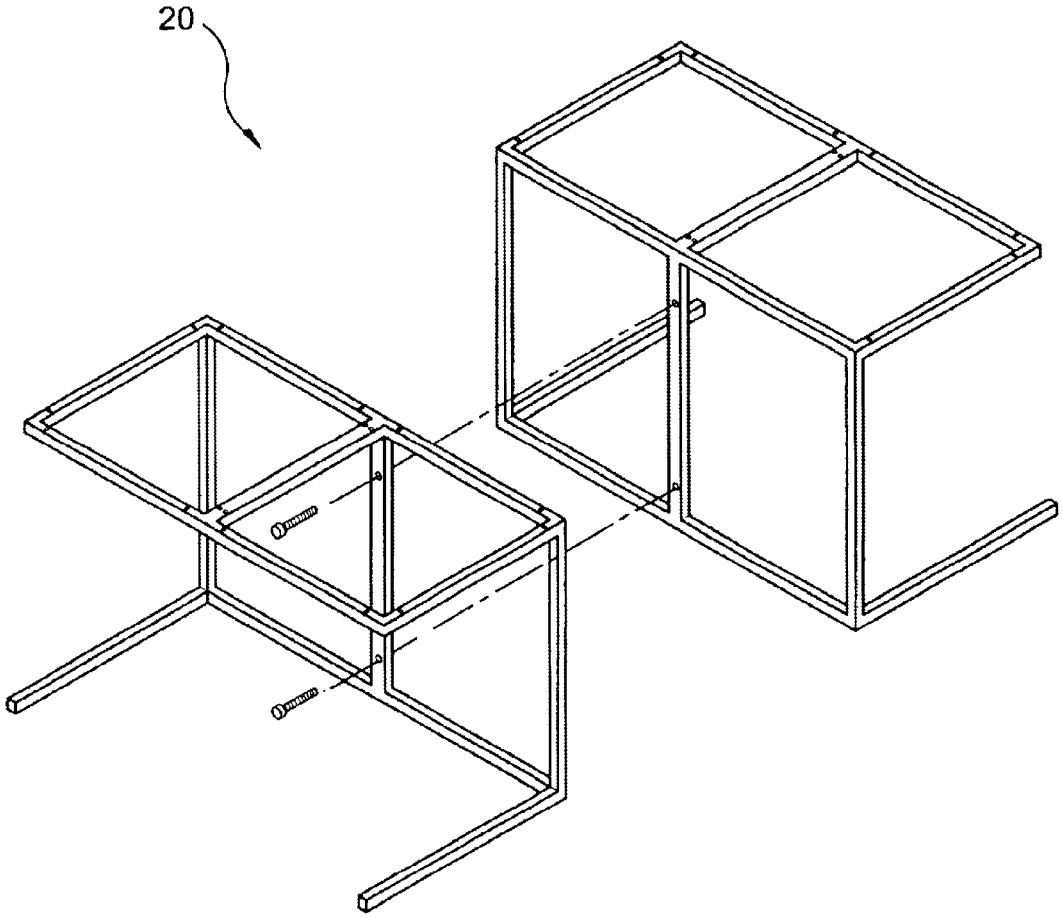
FIG. 28 is an exploded perspective view of a dual-frame alternate embodiment of the table assembly.

FIG. 28 is an exploded perspective view of an alternate embodiment of the table assembly 20 using a dual-frame assembly wherein each frame member can retain two board bases 12 and may be used individually or joined together for the simultaneous use of up to four board bases 12. The structural integrity is focused on a single side in order to provide more clearance on the side when the table is divided.

Figure 29:
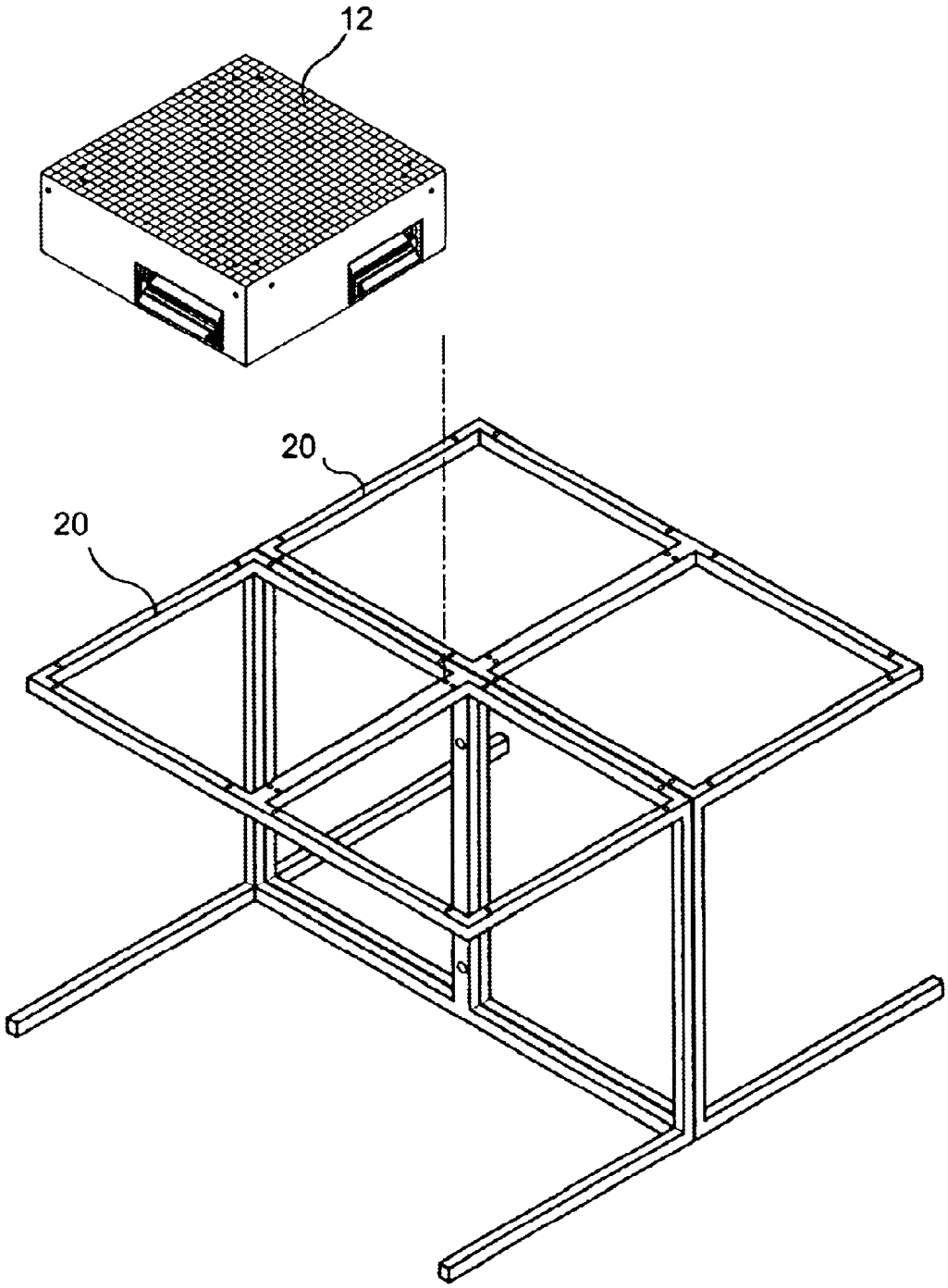
FIG. 29 is a perspective view of a dual-frame alternate embodiment of the table assembly.

FIG. 29 is a perspective view of an alternate embodiment of the table assembly 20 using a dual-frame assembly wherein the two frame members are attached so as to allow for simultaneous play on up to four boards 12.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A universal game board comprising:

a) a substantially square, box-like structure with four sidewalls and a top surface forming a board base wherein said top surface thereof is used as a game board, said top surface having a playing surface thereon;

b) a table frame assembly comprising at least three substantially horizontal cross members fixed end-to-end in perpendicular relation to one another and supported by leg members extending vertically downward at each corner for maintaining said board base therein;

c) a filler separator removably positionable on said board base to diminish the size of the playing surface, said filler separator having indicia that correspond with a grid on said game board to create definable coordinates including one surface with alphabetic letter A through Z and another surface with a numerical sequence 1 through 26;

d) game pieces, some of said game pieces being of varying sizes, markings and shapes and capable of being placed side by side in differentiating patterns and configurations to create the playing surface on the board base;

e) additional game pieces having holes to accommodate peg form pieces for vertically modifying the playing surface to accommodate any one of a plurality of games that may be created for play thereon; and f) means for storing said game pieces and peg form pieces when not in use.

2. A universal game board as recited in claim 1, wherein said board base further includes:

a) a grid marked on said game board;

b) a plurality of threaded through bores tapped peripherally into said top surface and in the upper portion of said sidewalls thereof;

c) at least one substantially rectangular recess extending medially from the surface of each said sidewall thereof, and d) a drawer element sized to slide within said rectangular recess with limited play.

3. A universal game board as recited in claim 1, wherein said table frame assembly further includes a plurality of threaded through bores tapped into the top portion of said cross members.

4. A universal game board as recited in claim 3, having a retaining lip wherein said retaining lip comprises a plurality of relatively L-shaped elongate board bounds having a plurality of recesses extending therethrough corresponding to the threaded through bores in said board base and said table frame cross members and screws for passing through said recesses and threading into said through bores for fastening said board bounds to said board base prior to securing said board bounds to said table frame assembly.

5. A universal game board as recited in claim 1, having b) a plurality of substantially square or rectangular plates that can be placed edge-to-edge or stacked to provide various elevations of the game board.

6. A universal game board as recited in claim 1, wherein said game pieces comprise:

a) a plurality of square plates called pittances;

b) a plurality of square plates called pits that are smaller than pittances;

c) a plurality of single hole pittances with a central recess extending therethrough;

d) a plurality of pit-poles which are similar to single hole pittances but have a plurality of recesses extending therethrough; and e) a plurality of peg-like baguettes having a vertical shaft that fits into said recess in said single hole pittances and pit poles.

7. A universal game board as recited in claim 1 further including a hinged, collapsible freezer container for storing pieces that are not in use.

8. A universal game board as recited in claim 1, further including a half board bound for maintaining continuity between two board bases when more than one board base is interconnected.

9. A universal game board as recited in claim 1, wherein said table frame assembly is configured to allow side-by-side placement of said board bases to create a larger playing surface.

10. A universal game board as recited in claim 1, further including a pivoting, adjustable cup-holder that can be selectively sized to accommodate cups of varying diameters.

* * * * *